US010966575B2

(12) United States Patent
Bateman et al.

(10) Patent No.: US 10,966,575 B2
(45) Date of Patent: Apr. 6, 2021

(54) SYSTEMS AND METHODS FOR A BATHING SYSTEM

(71) Applicant: Apollo Corporation, Somerset, WI (US)

(72) Inventors: Corey Allen Bateman, River Falls, WI (US); Nicholas Vernon Peterson, Woodbury, MN (US)

(73) Assignee: Apollo Corporation, Somerset, WI (US)

( * ) Notice: Subject to any disclaimer, the term of this patent is extended or adjusted under 35 U.S.C. 154(b) by 0 days.

(21) Appl. No.: 16/242,751

(22) Filed: Jan. 8, 2019

(65) Prior Publication Data

US 2020/0214506 A1 Jul. 9, 2020

(51) Int. Cl.
*A47K 3/00* (2006.01)
*A47K 3/02* (2006.01)

(52) U.S. Cl.
CPC ..... *A47K 3/001* (2013.01); *A47K 3/02* (2013.01)

(58) Field of Classification Search
CPC ..... A47K 3/001
USPC ..... 4/560.1
See application file for complete search history.

(56) References Cited

U.S. PATENT DOCUMENTS 5,545,335 A 8/1996 Sween et al.
6,807,689 B1 * 10/2004 Royko ..... A47K 3/10 4/541.1
8,152,233 B2 * 4/2012 Wechter ..... A47K 3/122 297/124
2004/0078888 A1 4/2004 Noro et al.
2005/0138723 A1 * 6/2005 Hind ..... A61H 33/6026 4/538

FOREIGN PATENT DOCUMENTS

CN 206239288 U 6/2017
DE 102017124271 A1 12/2018
EP 3040063 A1 7/2016

OTHER PUBLICATIONS

Chen Hao, Translation of CN Patent No. 206239288U, dated Jun. 13, 2017, Google Patents translation, 4 pages, https://patents.google.com/patent/CN206239288U/en?q=computer,intelligent,automatic,automated,electronic&q=bathtub,spa,bath,tub&q=door.
International Patent Application No. PCT/US2020/012007, International Search Report and Written Opinion dated Apr. 22, 2020, 11 pages.

(Continued)

*Primary Examiner* — Lori L Baker
(74) *Attorney, Agent, or Firm* — Fredrikson & Byron, P.A.

(57) ABSTRACT

A bathing system, includes a transfer system having a carrier base and a transfer seat. A sliding of the transfer seat relative to the carrier base may facilitate transfer of the transfer seat toward or away from the tub. A first arm and a second arm of the carrier base extends into and overlaps with a first support surface and a second support surface of the tub respectively. A controller may be in operative communication with a plurality of sensors and determine whether the bathing system is in a state where it is permissible to transfer the transfer seat toward or away from the tub and if so, actuate components of the transfer system to permit the transfer of a patient in the transfer system.

20 Claims, 13 Drawing Sheets

(56) References Cited

OTHER PUBLICATIONS

"Apollo Bath Advantage Bathing System," YouTube, Retrieved online from https://www.youtube.com/watch?v=04ylgNJqiPM, dated Apr. 4, 2011, 3 pages.
Penner Bathing Spas, Wayback Internet Archive, Retrieved online from https://web.archive.org/web/20181004120946/https://www.pennerbathingspas.com/ on May 30, 2020, archived Oct. 4, 2018, 1 page.
MasterCare Patient Equipment, Inc., Wayback Internet Archive, Retrieved online from https://web.archive.org/web/2018081923356/https://mastercarebath.com/#.W3n-bCPLeUk on May 30, 2020, archived Aug. 19, 2018, 1 page.
Bath Systems, Arjo, Retrieved online from https://www.arjo.com/en-us/products/hygiene/bath-systems/ on May 30, 2020, 2 pages.
Rane Tubs, Wayback Internet Archive, Retrieved online from https://web.archive.org/web/20180923184648/http://www.ranetubs.com/ on May 30, 2020, archived Sep. 23, 2018, 1 page.
Invacare Bathing Systems, YouTube, InvacareCorp, retrieved online from https://www.youtube.com/watch?v=aYQnxpjE7Y0&list=PLDACF4D859423F4A8&index=2, dated Apr. 1, 2014, 3 pages.

* cited by examiner

SYSTEMS AND METHODS FOR A BATHING SYSTEM

BACKGROUND

Immersion bathing and/or hydrotherapy for assisted and/or self-bathing in various medical care and long-term care institutions typically involves transporting a patient using a transfer system into a bathing tub. Many existing transfer methods do not adequately provide for patient dignity and safety and may be a source of embarrassment and/or anxiety for the bather. The safety shortcomings of such systems may sometimes result in fall, injury or even death of the patient due to user error, and/or lack of monitoring the transfer process.

SUMMARY

According to an embodiment, a bathing system, comprises a tub, comprising a tub chamber having a first support surface adjacent to a first lateral surface, and a second support surface being adjacent to the second lateral surface. The bathing system includes a transfer system, comprising: a carrier base comprising a first arm and a second arm opposite to the first arm, and a transfer seat operatively coupled to the carrier base, the transfer seat being lockable with respect to the carrier base to limit a first relative motion between the transfer seat and the carrier base, and the transfer seat being slidable with respect to the carrier base to facilitate relative motion between the transfer seat and the carrier base in a condition when the transfer system is engaged with the tub, the sliding of the transfer seat relative to the carrier base facilitating transfer of the transfer seat toward or away from the tub, wherein, when the transfer system is engaged to the tub, each of the first arm and the second arm of the carrier base extends into the tub such that the first arm overlaps with the first support surface over a first overlap distance, and the second arm of the carrier base overlaps with the second support surface of the tub over a second overlap distance.

In certain embodiments, the first overlap distance generally equals the second overlap distance. For instance, the first overlap distance equals between about 10% and about 50% of a depth of the first arm, and/or the second overlap distance equals between about 10% and about 50% of a depth of the second arm.

In optional embodiments, the transfer system may include a plurality of wheels operatively coupled to the transfer seat that may facilitate relative slidable movement between the transfer seat and the carrier base of the transfer system in the condition when the transfer system is engaged with the tub. Optionally, a first wheel may have a first surface and a second surface spaced apart from the first surface. The first surface may contact the first arm and the second surface may contact the first support surface. A second wheel may have a third surface and a fourth surface spaced apart from the third surface. The third surface may contact the second arm and the fourth surface may contact the second support surface. In certain embodiments, the first wheel may include a first spacer positioned between the first surface and the second surface for aligning the carrier base with respect to the first support surface. Further, optionally, the second wheel comprises a second spacer positioned between the third surface and the fourth surface, the second spacer aligning the carrier base with respect to the second support surface.

According to one embodiment, the first support surface comprises a first tapered leading surface, and the second support surface comprises a second tapered leading surface. The first tapered leading surface may facilitate engagement of the second surface to the first support surface, and the second tapered leading surface facilitating engagement of the fourth surface to the second support surface.

In an embodiment, the transfer system may include a first lock configured to lock the transfer seat to the carrier base and thereby limit the relative motion between the transfer seat and the carrier base.

Optionally, the transfer system may include a second lock comprising a second locking pin configured to lock the transfer seat to the carrier base and thereby limit the relative motion between the transfer seat and the carrier base. In certain embodiments, for instance, a first indent may be configured to capture the second locking pin to lock the transfer seat to the carrier base. The first support surface may include a second indent configured to capture the second locking pin after the transfer seat is received in the tub, to lock the transfer seat relative to the tub so as to limit a second relative motion between the transfer seat and the tub.

According to advantageous embodiments, the first support surface comprises a contoured portion, and the second locking pin comprises a transverse pin, the contoured portion engaging the transverse pin to unlock the second locking pin and thereby unlock the second lock after the transfer system engages with the tub. The transfer seat may include a handle configured to actuate the second lock and thereby lock or unlock the second locking pin with respect to portions of the carrier base and/or the tub.

In some embodiments, the tub and the carrier base may be locked with respect to each other by a tub lock. The tub lock may include a latch and the carrier base may include a carrier pin. In further optional embodiments, the carrier base may include a plurality of alignment wheels to abut a corresponding alignment surface of the tub and thereby align the transfer system with the tub. In such cases, the tub lock may be locked to the carrier base after alignment. For instance, the carrier pin is captured within the tub lock when each wheel of the plurality of alignment wheels abuts the corresponding alignment surface of the tub. Advantageously, the transfer seat is slidable with respect to the carrier base and slid into and/or out of the tub after the carrier pin is captured in the tub lock to improve safety of transfers.

In certain embodiments, the transfer seat and the carrier base may be in either a locked position or an unlocked position with respect to each other (e.g., via a first lock). The locked position may limit a first relative motion, for instance, relative sliding between the transfer seat and the carrier base. The unlocked position may facilitate relative motion, for instance, sliding between the transfer seat and the carrier base. The sliding of the transfer seat relative to the carrier base may facilitate transfer of the transfer seat toward or away from the tub.

The bathing system may include a plurality of sensors. At least a first sensor of the plurality of sensors may sense a position of a first component of the tub or a second component of the transfer system and to generate one or more signals representative thereof. The first sensor may sense the position of the first component of the tub or the second component of the transfer system during or after movement of the transfer system relative to the tub. A controller may be in operative communication with each sensor of the plurality of sensors. The controller may be configured to receive the one or more signals generated by the first sensor, and may be configured to: determine, from the one or more signals, whether the position of at least the first component of the tub or the second component of the transfer system corresponds to a state where it is permissible to transfer the transfer seat toward or away from the tub; if the controller determines that the one or more signals corresponds to a first state where it is permissible to transfer the transfer seat toward or away from the tub, generate a first output, wherein, the first output includes a first signal for moving the transfer seat and/or the carrier base from the locked position to the unlocked position; and if the controller determines that the one or more signals corresponds to a second state where it is not permissible to transfer the transfer seat toward or away from the tub, generate a second output, wherein, the second output includes a second signal for maintaining the transfer seat and/or the carrier base in the locked position.

In optional embodiments, the first sensor may include a proximity sensor configured to sense whether the transfer system is engaged to the tub. The tub may include a tub lock and the carrier base may include a carrier pin. For instance, the tub lock may be a latch with a slot. The slot may capture the carrier pin, and thereby lock the carrier base relative to the tub. In such cases, the proximity sensor may be configured to sense a distance between the carrier pin and the tub lock is less than a threshold distance. If the distance between the carrier pin and the tub lock is less than the threshold distance, the controller may generate a first signal. Further, optionally, upon receipt of the first signal, the controller determines that the first signal corresponds to the first state where it is permissible to transfer the transfer seat toward or away from the tub. The controller determines that it is not permissible to transfer the transfer seat toward or away from the tub in the absence of the first signal.

In certain embodiments, a display may be in operative communication with the controller. The controller may be configured to communicate with the display to display the first output and/or the second output.

According to advantageous embodiments, the transfer seat may be lockable with respect to the carrier base by at least one lock. The plurality of sensors may include a second sensor to sense whether the at least one lock is in a locked state and generate a second signal. The controller may be in operative communication with the second sensor. Upon receipt of the second signal, the controller may be configured to generate a third output.

In one embodiment, the tub may include a tub door to move between an open position and a closed position, wherein, the tub door is in the open position during transfer of the transfer seat into the tub. In some such cases, a third sensor may sense whether the tub door is in the open position, and generate a third signal. Upon receipt of the third signal, the controller is configured to generate a fourth output. The third sensor may generate a fourth signal when the tub door is in the closed position. The controller may determine, based on the fourth signal whether the tub is in a state so as to be filled with liquids, and if the controller determines that the tub is in a state so as to be filled with liquids, initiate a tub fill operation, or if the controller determines that the tub is in a state not to be filled with liquids, prevent liquids from filling the tub to a level greater than a predetermined level.

Optionally, the bathing system may include one or more nozzles to generate one or more whirlpool jets. A fourth sensor may sense a level of liquid in the tub and generate a fifth signal. The controller may determine, based on the fifth signal, whether the tub is in a state so as to actuate the one or more nozzles. If the controller determines that the tub is in a state so as to actuate the one or more nozzles, actuate the one or more nozzles. The controller may determine, based on the fifth signal, whether the tub is in a state so as to not actuate the one or more nozzles, and if the controller determines that the tub is in a state so as to not actuate the one or more nozzles, does not actuate the one or more nozzles.

In further advantageous embodiments, a fifth sensor may sense a level of a cleaning solution in the tub during a cleaning operation. A sixth sensor configured to sense a temperature of a liquid in the tub.

Embodiments also include the following numbered embodiments:

1. A bathing system, comprising:

a tub, comprising:

a tub chamber defined by a bottom surface, a front surface, a back surface, a first lateral surface and a second lateral surface, the first lateral surface being opposite to the second lateral surface, the tub chamber configured to hold a liquid received from a liquid source, a first support surface the first support surface being adjacent to the first lateral surface, and a second support surface, the second support surface being adjacent to the second lateral surface; and a transfer system, engageable with the tub, the transfer system comprising:

a carrier base comprising a first arm and a second arm opposite to the first arm, and a transfer seat operatively coupled to the carrier base, the transfer seat being lockable with respect to the carrier base to limit a first relative motion between the transfer seat and the carrier base, and the transfer seat being slidable with respect to the carrier base to facilitate relative motion between the transfer seat and the carrier base in a condition when the transfer system is engaged with the tub, the sliding of the transfer seat relative to the carrier base facilitating transfer of the transfer seat toward or away from the tub, wherein, when the transfer system is engaged to the tub, each of the first arm and the second arm of the carrier base extends into the tub such that the first arm overlaps with the first support surface over a first overlap distance, and the second arm of the carrier base overlaps with the second support surface of the tub over a second overlap distance.

2. The bathing system of embodiment 1, wherein the first overlap distance generally equals the second overlap distance.

3. The bathing system of embodiment 1 or 2, wherein the first overlap distance equals between about 10% and about 50% of a depth of the first arm, and/or the second overlap distance equals between about 10% and about 50% of a depth of the second arm.

4. The bathing system of embodiment 1 or any previous embodiment, wherein the transfer system comprises a plurality of wheels operatively coupled to the transfer seat, the plurality of wheels facilitating relative slidable movement between the transfer seat and the carrier base of the transfer system in the condition when the transfer system is engaged with the tub.

5. The bathing system of embodiment 4 or any previous embodiment, wherein, the plurality of wheels includes:

a first wheel having a first surface and a second surface spaced apart from the first surface, the first surface being configured to contact the first arm and the second surface being configured to contact the first support surface; and a second wheel having a third surface and a fourth surface spaced apart from the third surface, the third surface being configured to contact the second arm and the fourth surface being configured to contact the second support surface.

6. The bathing system of embodiment 5 or any previous embodiment, wherein the first support surface comprises a first tapered leading surface, and the second support surface comprises a second tapered leading surface.
7. The bathing system of embodiment 6 or any previous embodiment, wherein the first tapered leading surface facilitating engagement of the second surface to the first support surface, and the second tapered leading surface facilitating engagement of the fourth surface to the second support surface.
8. The bathing system of embodiment 1 or any previous embodiment, wherein the transfer system comprises a first lock configured to lock the transfer seat to the carrier base and thereby limit the relative motion between the transfer seat and the carrier base.
9. The bathing system of embodiment 8 or any previous embodiment, wherein the transfer system comprises a second lock comprising a second locking pin configured to lock the transfer seat to the carrier base and thereby limit the relative motion between the transfer seat and the carrier base.
10. The bathing system of embodiment 9 or any previous embodiment, wherein carrier base comprises a first indent configured to capture the second locking pin to lock the transfer seat to the carrier base.
11. The bathing system of embodiment 10 or any previous embodiment, wherein the first support surface comprises a second indent configured to capture the second locking pin after the transfer seat is received in the tub, to lock the transfer seat relative to the tub so as to limit a second relative motion between the transfer seat and the tub.
12. The bathing system of embodiment 10 or any previous embodiment, wherein the first support surface comprises a contoured portion, and the second locking pin comprises a transverse pin, the contoured portion engaging the transverse pin to unlock the second locking pin and thereby unlock the second lock after the transfer system engages with the tub.
13. The bathing system of embodiment 9 or any previous embodiment, wherein the transfer seat comprises a handle configured to actuate the second lock and thereby lock or unlock the second locking pin with respect to portions of the carrier base and/or the tub.
14. The bathing system of embodiment 1 or any previous embodiment, wherein the carrier base comprises a plurality of alignment wheels, each alignment wheel of the plurality of alignment wheels being configured to abut a corresponding alignment surface of the tub and thereby align the transfer system with the tub.
15. The bathing system of embodiment 14 or any previous embodiment, wherein the carrier base comprises a carrier pin and the tub comprises a latch, the latch having a slot configured to capture the carrier pin, and thereby lock the carrier base relative to the tub.
16. The bathing system of embodiment 15 or any previous embodiment, wherein the carrier pin is captured within the latch when each wheel of the plurality of alignment wheels abuts the corresponding alignment surface of the tub.
17. The bathing system of embodiment 14 or any previous embodiment, wherein the transfer seat is slidable with respect to the carrier base and slid into and/or out of the tub after the carrier pin is captured in the latch.
18. The bathing system of embodiment 5 or any previous embodiment, wherein the first wheel comprises a first spacer positioned between the first surface and the second surface, the first spacer vertically aligning the carrier base with respect to the first support surface.
19. The bathing system of embodiment 5 or any previous embodiment, wherein the second wheel comprises a second spacer positioned between the third surface and the fourth surface, the second spacer vertically aligning the carrier base with respect to the second support surface.
20. The bathing system of embodiment 19 or any previous embodiment, wherein the first spacer vertically aligning the transfer seat to the first arm of the carrier base, and the second spacer vertically aligning the transfer seat to the second arm when transferring the transfer seat out of the tub.

The details of one or more examples are set forth in the accompanying drawings and the description below. Other features, objects, and advantages will be apparent from the description and drawings, and from the claims.

DETAILED DESCRIPTION

Illustrative embodiments disclosed herein relate to a bathing system 100 for use in immersion bathing and/or hydrotherapy sessions for patients in medical care and long-term care institutions.

Tub Architecture

Figures 1A, 1B:
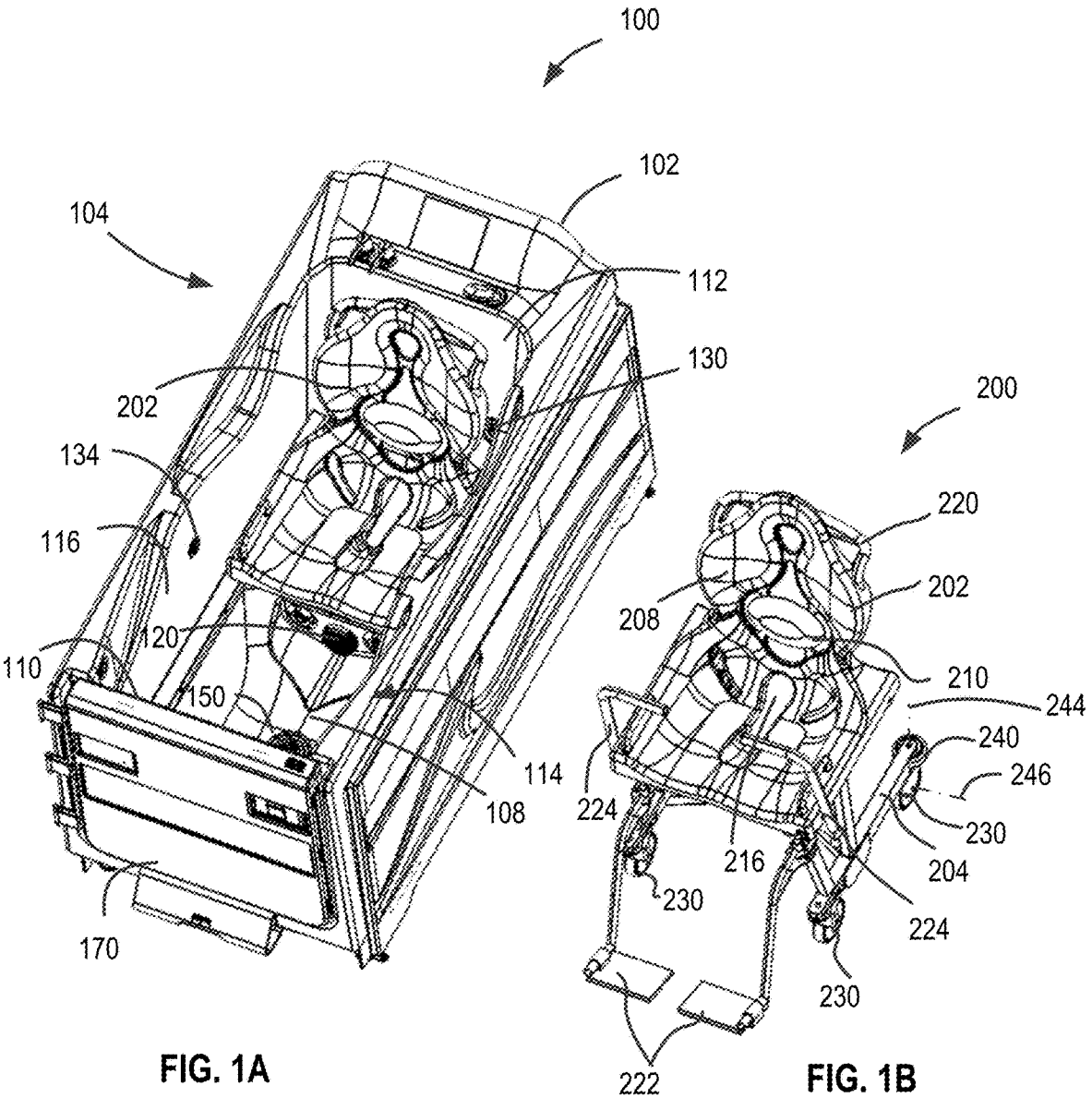
FIG. 1A illustrates a perspective view of an exemplary bathing system according to a non-limiting embodiment.
FIG. 1B illustrates a perspective view of an exemplary transfer system according to a non-limiting embodiment.
Figure 1C:
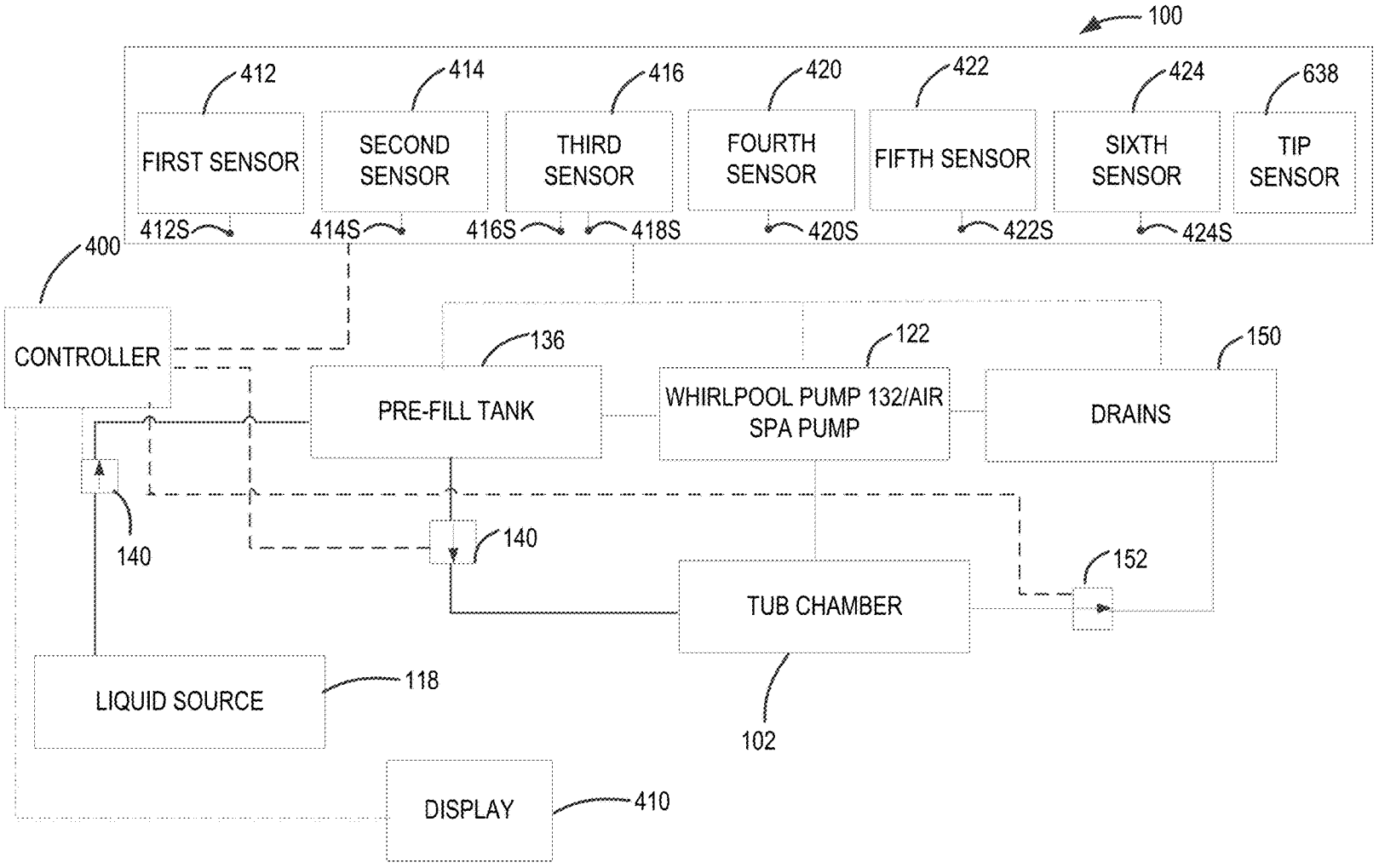
FIG. 1C illustrates a schematic view of various components of the bathing system of FIGS. 1A and 1B.

FIGS. 1A and 1B illustrate perspective views of exemplary embodiments of a bathing system 100 and portions of a transfer system 200 while FIG. 1C illustrates a schematic of the bathing system 100 and transfer system 200 according to several disclosed embodiments. The bathing system 100 may include a tub 102. The tub 102 may include a tub chamber 104. The tub chamber 104 can be defined by a bottom surface 108, a front surface 110, a back surface 112, a first lateral surface 114 and a second, opposite, lateral surface 116.

The tub chamber 104 may hold a liquid received from a liquid source 118 (e.g., liquid tank, a water supply conduit, etc.). In certain aspects, the tub 102 may include one or more inlet ports 120 in operative communication with the liquid source 118 to receive, and thereby fill the tub chamber 104. In one embodiment, the liquid may include water. In such cases, the tub may be receive water at desired temperature. In optional embodiments, the tub may be in fluid communication with a hot water port and a cold water port to receive hot and cold water, respectively. In another embodiment, the liquid may include a bathing, skin care, and/or hydrotherapy product in combination with water. In yet another embodiment, the liquid may include a cleaning solution for cleaning the tub chamber 104 when not in use. Additionally, the liquid may include a disinfecting liquid dispensed into the tub to reduce or eliminate any pathogens present on the tub surfaces. Periodic cleaning and disinfecting may lead to improved sanitary conditions, and may be performed in conjunction with a controller. In such cases, instructions for cleaning and/or disinfecting. Additionally, the controller may automatically dispense and/or dilute the liquids to suitable concentrations during cleaning and/or dispensing cycles, to ensure that cleaning and dispensing operations are performed consistently and correctly to comply with regulatory standards.

The inlet port 120 may be situated anywhere on the tub chamber 104. In advantageous aspects, the inlet port 120 may be positioned below a center-plane of the tub chamber 104 (e.g., at or near the bottom surface 108 as seen in FIG. 1A). Such embodiments may allow for reduced noise during filling of the tub 102 and/or less turbulent filling of the tub 102, in turn ensuring comfort for persons suffering cognitive impairments such as anxiety, dementia, Alzheimer's disease, or others.

In certain optional embodiments, and with continued reference to FIGS. 1A and 1C, the tub chamber 104 may include a fluid agitation system 122. The fluid agitation system 122 may be a whirlpool system in some embodiments. Alternatively or in addition, the fluid agitation system 122 may be an air spa system. In each case, the fluid agitation system 122 can include one or more nozzles 130 that can generate a jet of fluid (liquid, in the case of whirlpool system, or air in the case of air spa system). In embodiments where the fluid agitation system 122 is a whirlpool system, a whirlpool pump 132 may be provided and may be in fluid communication (e.g., directly, or indirectly via the inlet port 120) with the liquid source 118 and/or the one or more nozzles 130. In some such embodiments, the fluid agitation system 122 can also include one or more liquid circulation outlets 134. The nozzles 130 and/or outlets can be shaped, oriented and/or positioned to provide desirable liquid circulation properties. For instance, in an embodiment, the liquid circulation outlets 134 can be shaped and oriented to increase aeration at certain flow rates, while reducing backpressure within the whirlpool system. Advantageously, such embodiments may facilitate the use of a smaller whirlpool pump 132, a lower overall power consumption or reduced noise during operation of the bathing system 100.

In optional embodiments, the bathing system 100 may include a pre-fill tank 136 in fluid communication with the liquid source 118. The pre-fill tank 136 may advantageously provide a faster filling of the tub chamber 104. In some embodiments, the pre-fill tank 136 may communicate with the liquid source 118 prior to the use of the tank, and may store a desired quantity of liquid, which may correspond to a sufficient volume of liquid (e.g., water) to fill the tub. (e.g., several gallons of water). The pre-fill tank 136 may include a pre-fill level sensor (e.g., a float valve) to monitor the level of liquid in the pre-fill tank 136, and fluidly decouple the pre-fill tank 136 from the liquid source 118. In certain aspects, the pre-fill tank 136 may fluidly communicate with the tub chamber 104 via gravity to fill the tub chamber 104. In additional or alternative embodiments, the pre-fill tank 136 may be in operative communication with a whirlpool pump 132 of the whirlpool system to facilitate accelerated filling of the tub chamber 104. Such embodiments may reduce the wait time for filling the tub chamber 104, and may advantageously be automated, as will be described further herein.

According to certain exemplary embodiments, several components of the tub 102 may include electronic components and may be controlled by a controller 400 according to one or more control algorithms. In one example, the tub 102 may include fill valves 140 that may include electronic components (e.g., valves) that may be actuated electronically (e.g., via a signal) to open or close. The fill valves 140 may be in fluid communication with the liquid source 118 to permit filling of the tub 102 with liquid from the liquid source 118. Optionally, the tub 102 may include a shower wand 142 as shown in FIG. 1A. The shower wand 142 may include another electronic valve in fluid communication with the liquid source 118 to permit flow of liquid from the liquid source 118 to the shower wand 142. One or more temperature sensors may monitor temperature of liquid entering the fill valve and/or the shower wand 142. The temperature of incoming liquid may also be controlled using an auxiliary control system (e.g., a thermostatic mixing valve). In embodiments where a thermostatic mixing valve is provided, the thermostatic mixing valve may adjust flow rates of hot and cold liquid (e.g., water) to reach a desired water temperature. Advantageously, the thermostatic mixing valve may facilitate maintaining the liquid at a constant temperature despite pressure or temperature variations that may occur in the liquid supply, for instance, in hot and cold water sources. Additionally, the thermostatic mixing valve may be in operative communication with a temperature sensor and a controller (to be described further), and may monitor the temperature of the liquid to ensure that the liquid temperature is less than a maximum temperature (e.g., to reduce the chances of accidental scalding).

In further optional embodiments, the tub chamber 104 may include one or more drains 150 to permit drainage of liquids in the tub chamber 104. The drains 150 may be electrically actuable. For example, each of the one or more drains 150 may include an electronic valve 152 which may be actuated (e.g., via an electric signal) to open or close to drain or stop drainage of the liquids from the tub 102. In additional or alternative embodiments, drainage of liquids may be accelerated by engaging the whirlpool pump. In such cases, a plurality of valves may be provided and in fluid communication with the whirlpool nozzles, pump 132, drains 150. A valve of the plurality of valves may fluidly disconnect the whirlpool nozzles from the whirlpool pump 132. Another valve may fluidly connect the whirlpool pump 132 to the drain. Actuation of the whirlpool pump 132 in this state may, instead of actuating the nozzles, facilitate drainage of the tub.

In certain aspects, with continued reference to FIG. 1A, the tub 102 may include several advantageous features, such as a plurality of removable side panels for ease of access for maintenance, integrated arm rests for the patient, and the like. Optional components may also include a weighing system comprising one or more distributed load cells, which may take a patient's weight while in the tub 102.

Figure 3:
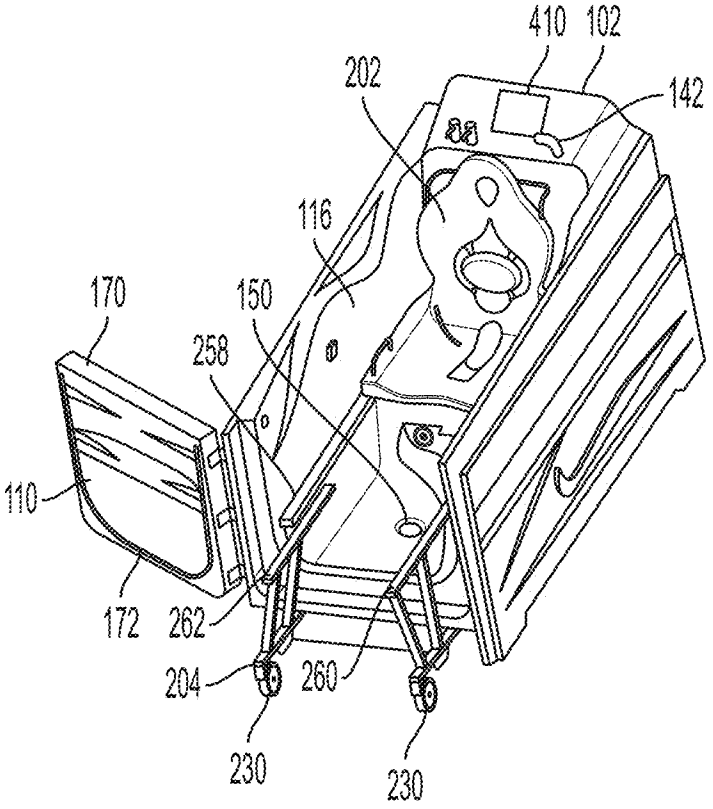
FIG. 3 illustrates a perspective view of the bathing system of FIG. 1A, after transfer of the transfer seat into the tub.
Figure 2:
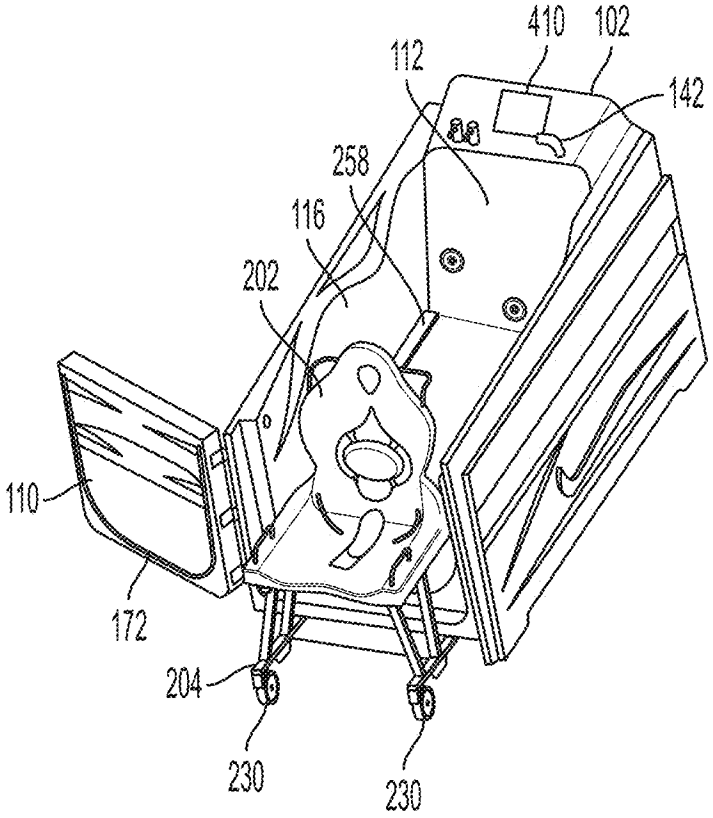
FIG. 2 illustrates a perspective view of the bathing system of FIG. 1A, prior to transfer of the transfer seat into the tub.

With continued reference to FIG. 1A, to the tub 102 includes a tub door 170. The tub door 170 may be movable between a closed position as illustrated in FIG. 1A and an open position as illustrated in FIGS. 2 and 3. The tub door 170 may be locked into the closed position by a mechanical connection (e.g., pawls, fasteners, locks, and the like). The tub door 170 may be connected to the tub chamber 104 by a hinged connection. As best seen in FIGS. 2 and 3, the tub door 170 may include one or more seals 172 that may provide a fluid-tight seal to reduce or eliminate fluid leaks when the tub door 170 is closed. As mentioned previously, the tub chamber 104 may be defined by one or more tub 102 surfaces, including a tub 102 front surface 110. In the illustrated embodiments of FIGS. 1A, 2 and 3, the tub 102 front surface 110 is an interior surface of the tub door 170.

Transfer System Overview

Referring to FIG. 1B, the bathing system 100 includes a transfer system 200. The transfer system may be useful for transferring a patient (e.g., a patient in a medical care facility or a resident in a long-term care facility) from a location (e.g., a room in a medical or long-term care facility) into the tub 102. The transfer system may be engageable with respect to the tub 102 to facilitate transfer of a patient into or out of the tub 102, as will be described further below. The transfer system, as seen in FIG. 1B, may include a transfer seat 202 for receiving a patient in a seated position. The transfer seat 202 may be supported by a carrier base 204.

With continued reference to FIG. 1B, in optional embodiments, the transfer seat 202 may be contoured for resident comfort and support. In additional optional embodiments, the transfer seat 202 may include support surfaces that support the person seated in the transfer seat 202. For instance, in one embodiment, the transfer seat surfaces 208 may cradle the torso of a person seated in the transfer seat 202, so as to facilitate more upright seating. Such embodiments may be beneficial for persons with poor muscle control. In additional or alternative aspects, the transfer seat 202 may include a movable and repositionable lumbar support pad 210 that may be positioned and/or repositioned to best support the resident. The transfer seat 202 may also include one or more restraints or safety belts, such as belts, harnesses and the like to support and/or restrain a patient during transportation via the transfer system and/or during bathing to improve safety.

In further optional embodiments, the transfer seat 202 may include one or more openings 216. During use, the openings 216 may facilitate drainage of liquids. Optionally, the openings 216 may be provided at locations that form lowermost portions of the transfer seat 202. In certain embodiments, one or more openings 216 may also facilitate exposure of a patient's perineal region. Such embodiments may facilitate directing liquid from one or more nozzles 130 (e.g., of the whirlpool system) toward a patient's perineal region to augment caregiver's administration of perineal hygiene.

As seen in FIG. 1B, in illustrative embodiments, the transfer seat 202 may include a handle 220. The handle 220 may advantageously be positioned to the rear of a centerplane of the transfer seat 202. During use, a caregiver may grasp the handle 220 for maneuvering the transfer system, and optionally, for positioning the transfer seat 202 within the tub 102 as will be described further below.

FIG. 2 illustrates the transfer seat 202 during the process of transfer, while FIG. 3 illustrates the transfer seat 202 when the transfer seat 202 has been transferred into the tub 102. After transfer of the transfer seat 202, the carrier base 204 may be undocked from the tub 102 and may be moved out of the way of the tub door 170. The tub door 170 may then be closed and the tub 102 filled with water. The carrier base 204 may be re-docked to the tub 102 to facilitate the transfer of the transfer seat 202 from the tub 102 toward the carrier base 204.

In certain optional embodiments, as seen in FIG. 1B, the carrier base 204 may include removable and position-adjustable footrests 222 to support a patient's feet. The footrests may provide support to the patient's feet while the transfer seat 202 is exterior to the tub 102 (e.g., during transportation of the patient). The footrests may be adjusted to accommodate varying leg lengths. Optionally, the foot rests may be removed from the carrier base 204.

With continued reference to FIG. 1A, according to some embodiments, the carrier base 204 may include a pair of lateral handles 224. The lateral handles 224 may be coupled to and extend from the carrier base 204. The lateral handles 224 may facilitate moving the transfer system (e.g., by a caregiver), when a caregiver is standing in front of a patient. For instance, during use, the caregiver may grasp the lateral handles 224 and push or pull the transfer seat 202 in a guided fashion using the lateral handles 224 to move the transfer seat 202 relative to the tub 102. In advantageous aspects, the lateral handles 224 may be pivotable relative to the carrier base 204. For example, the lateral handles 224 may pivot upwards and outwards (e.g., as shown in FIG. 1B) to move out of the way during seating of a patient into the transfer seat 202, or during transfer of the patient from the transfer seat 202, so as to not obstruct access to the patient.

According to illustrative embodiments, components of the transfer system may be made of waterproof materials. In certain advantageous aspects, the transfer seat 202 may include an antimicrobial material. Further, in optional embodiments, the transfer seat 202 may include a removable commode pan for patient incontinence prior to bathing and/or hydrotherapy.

As mentioned previously, the transfer seat 202 may be supported by a carrier base 204. The transfer seat 202 may be operatively (e.g., slidably) coupled to the carrier base 204. For instance, in certain instances, the transfer seat 202 may be slidable with respect to the carrier base 204 to facilitate relative motion between the transfer seat 202 and the carrier base 204, thereby facilitating transfer of the transfer seat 202 toward or away from the tub 102 (e.g., as illustrated in FIGS. 2 and 3). In other instances, the transfer seat 202 may be lockable with respect to the carrier base 204 to limit a first relative motion between the transfer seat 202 and the carrier base 204 prior to engagement of the transfer system and the tub 102.

Referring again to FIG. 1B, the carrier base 204 may be supported by a plurality of wheels 230. The wheels may, in some embodiments, be casters. One or more casters may optionally swivel for controlled movement of the transfer seat when used with high weight loads. In such embodiments, the caster(s) that swivel may include a mechanical lock to lock the caster(s) from moving while patients move into or out of the transfer seat. The mechanical lock may also offer additional safety when the carrier base is docked to the tub. While the illustrated embodiment shows four wheels, additional or fewer wheels are contemplated within the scope of the present disclosure. The plurality of wheels may permit transportation of a patient seated in the transfer seat 202.

Tub Carrier Base Docking System

Figure 4A:
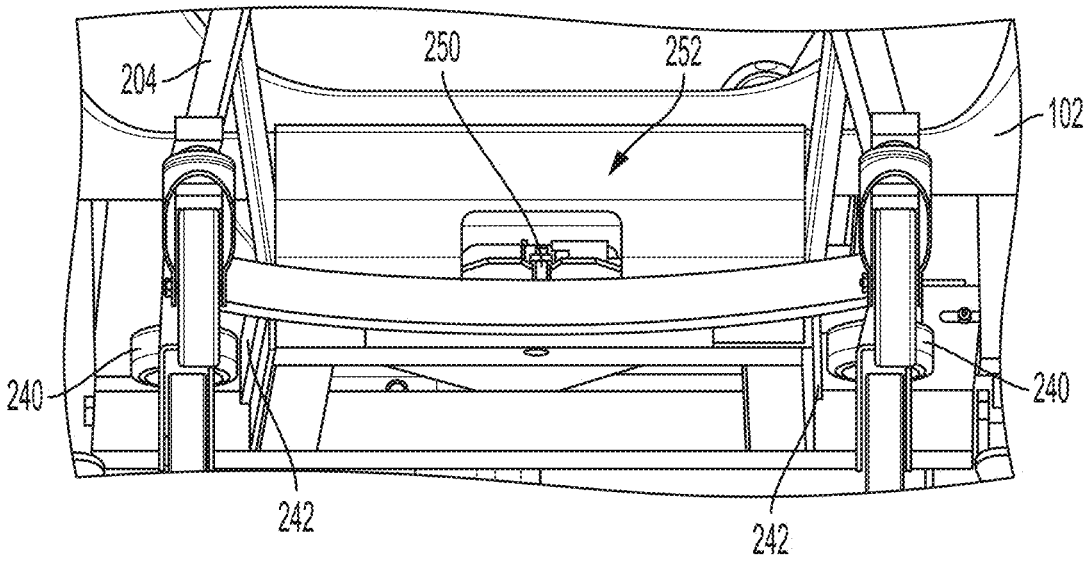
FIG. 4A illustrates a lower front view of the tub of FIG. 1A with the carrier base of FIG. 1B docked to the tub.
Figure 4B:
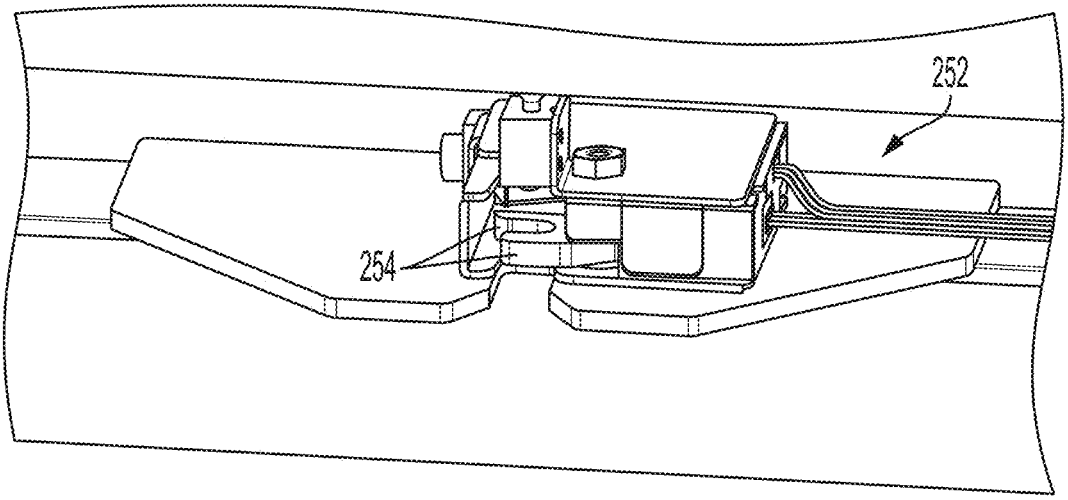
FIG. 4B illustrates an enlarged lower front view of the tub of FIG. 1A to illustrate portions of the tub lock.
Figure 5:
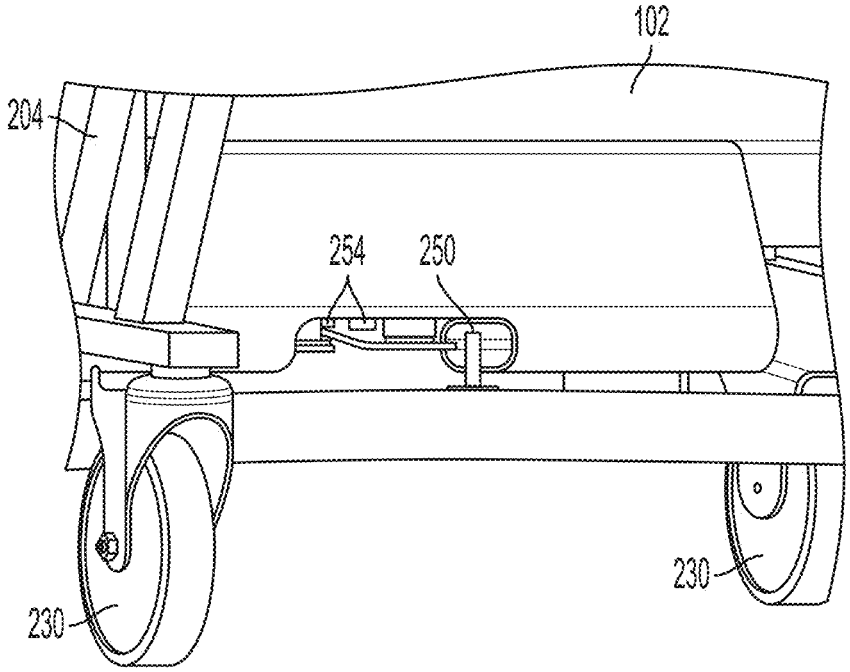
FIG. 5 illustrates a lower front view of the tub of FIG. 1A with the carrier base of FIG. 1B unlocked to the tub.
Figure 6:
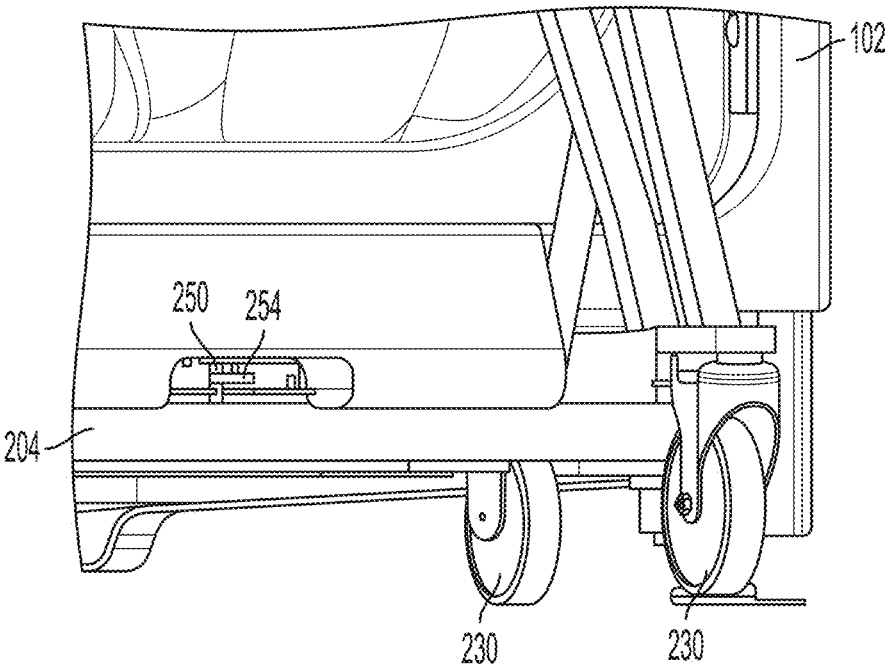
FIG. 6 illustrates a lower front view of the tub of FIG. 1A with the carrier base of FIG. 1B locked to the tub.

Referring now to FIGS. 4A-4B, the carrier base 204 and the tub 102 may each include cooperative elements that may cooperate to dock the carrier base 204 relative to the tub 102. The docking may restrict relative motion between the carrier base 204 and the tub 102 to facilitate transfer of the patient. In some embodiments, the carrier base 204 may be aligned with respect to the tub 102. In such embodiments, the carrier base 204 may include a plurality of alignment wheels 240. Each alignment wheel may abut a corresponding alignment surface 242 of the tub 102 to align the transfer system with the tub 102 prior to engaging therewith. In alternative or additional embodiments, the transfer system may include corresponding structures on the tub and the carrier base to provide alignment. Such corresponding structures may include complementary surfaces, tapered pins and/or holes, and the like that may engage with each other to provide alignment between the transfer system and the tub.

Referring back to FIG. 1B, in certain optional embodiments, the alignment wheels 240 may have a rotational axis 244 generally perpendicular to the axis of rotation 246 of the wheels of the carrier base 204. For instance, in the illustrated embodiment, the alignment wheels 240 may be disposed on a generally horizontal plane, with a rotational axis disposed generally vertically. However, in alternative embodiments, the alignment wheels 240 may be at other orientations.

As seen in FIGS. 1B and 4A, the alignment wheels 240 may abut a corresponding alignment surface 242. In the illustrated embodiment, the alignment wheels 240 may be provided on the bottom portion of the carrier base 204. Similarly, the corresponding alignment surfaces 242 may be provided on a bottom portion of the tub 102. Alternatively, alignment wheels 240 and the aligning surfaces may be provided on other surfaces. While alignment wheels 240 and aligning surfaces are illustrated, other types of structures (e.g., frictional engagement of cooperative mechanical structures, electronic systems, etc.) that may provide alignment (or an indication of offset) between the transfer system and the tub 102 are contemplated within the scope of the present disclosure.

Referencing FIGS. 4A, 4B, 5 and 6, the carrier base 204 and the tub 102 may include cooperative structures to lock the carrier base 204 with respect to the tub 102 to restrict relative motion therebetween. For instance, in the illustrated embodiment, the carrier base 204 may have a carrier pin 250. The tub 102 may include a tub lock 252. Any type of lock can be used. In the illustrated exemplary embodiment, the tub lock 252 may include a latch with a pair of spring-biased jaws 254. The spring-biased jaws may be actuated (e.g., mechanically by a caregiver, automatically upon detection of the carrier base 204, etc.) to capture the carrier pin 250, and thereby lock the carrier base 204 with respect to the tub 102. In one example, actuation of the spring-biased jaws to capture the carrier pin 250 may be accomplished by the carrier pin 250 bearing against the surface of the jaws 254 (e.g., in a manner similar to actuation of a car door latch). Alternatively, the actuation of the spring-biased jaws may be accomplished by other mechanical or electronic systems, or a combination thereof. As will be further described below with reference to FIGS. 17A-D, the tub lock 252 may be monitored by a controller to ensure that the tub lock 252 is in a closed position and/or not mechanically releasable during transfer. Additional sensors (e.g., proximity sensors) may monitor and ensure that the carrier pin 250 is captured within the tub lock 252 prior to, or during transfer. Once locked, the transfer system has been engaged with the tub 102, and the bathing system 100 may be ready for transfer of a patient into or out of the tub 102.

Resident Transfer Mechanism

Figure 7:
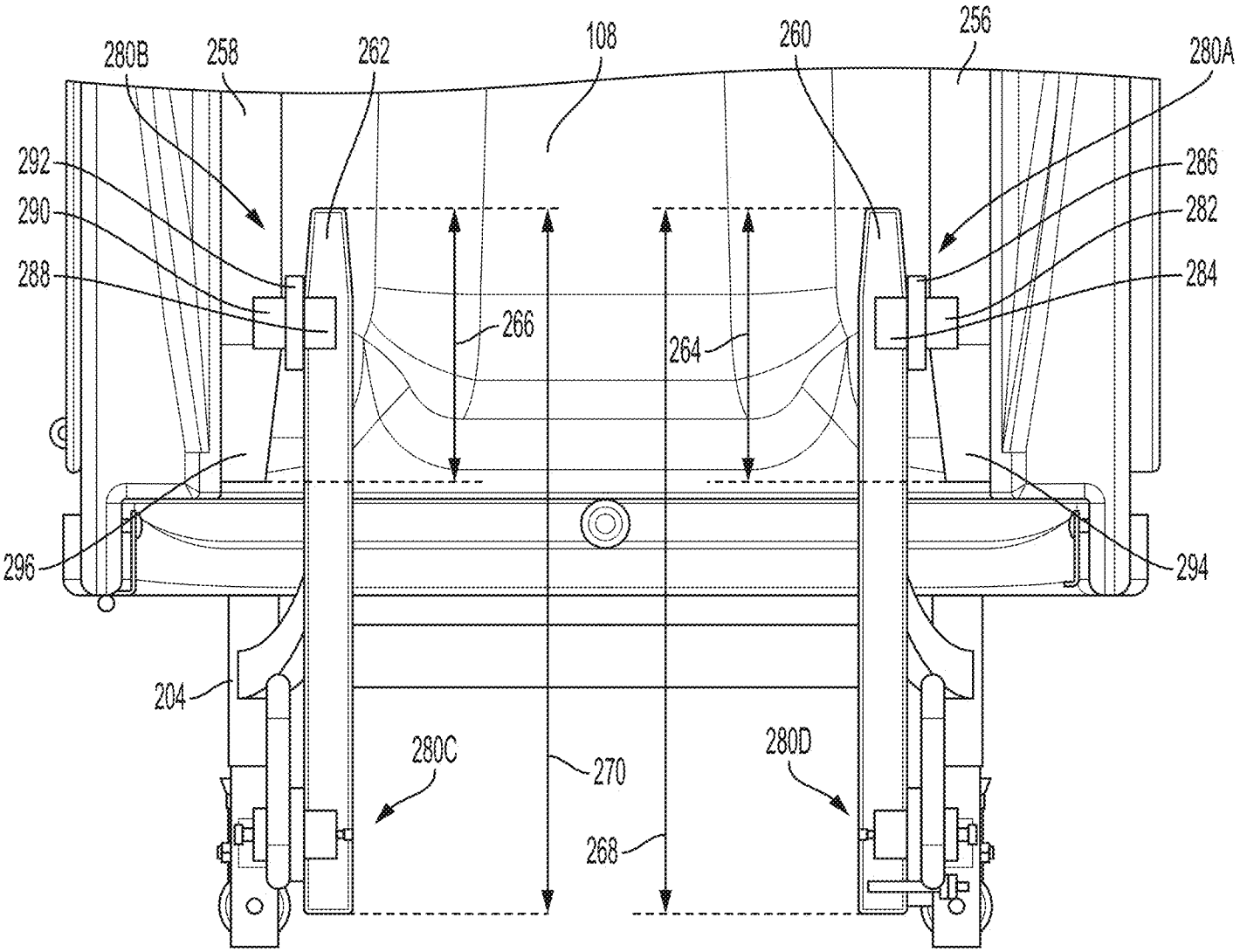
FIG. 7 illustrates a top view of the tub of FIG. 1A with the carrier base of FIG. 1B docked to the tub.

With reference to FIGS. 1A and 7, the tub 102 may include a first support surface 256 and a second support surface 258. The first support surface 256 may be adjacent to the first lateral surface 114. The second support surface 258 may be adjacent to the second lateral surface 116. The first support surface 256 and the second support surface 258 may therefore be opposite to each other. Each of the first support surface 256 and the second support surface 258 may support the transfer seat 202 during transfer and/or during use of the tub 102, as will be described further below.

Figure 8:
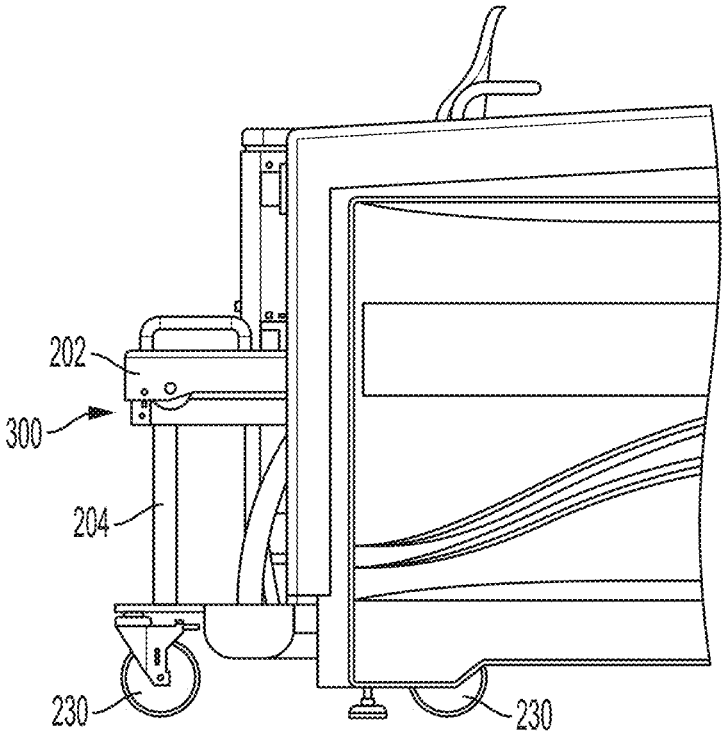
FIG. 8 illustrates a side view of the tub of FIG. 1A with the carrier base of FIG. 1B docked to the tub.
Figure 9:
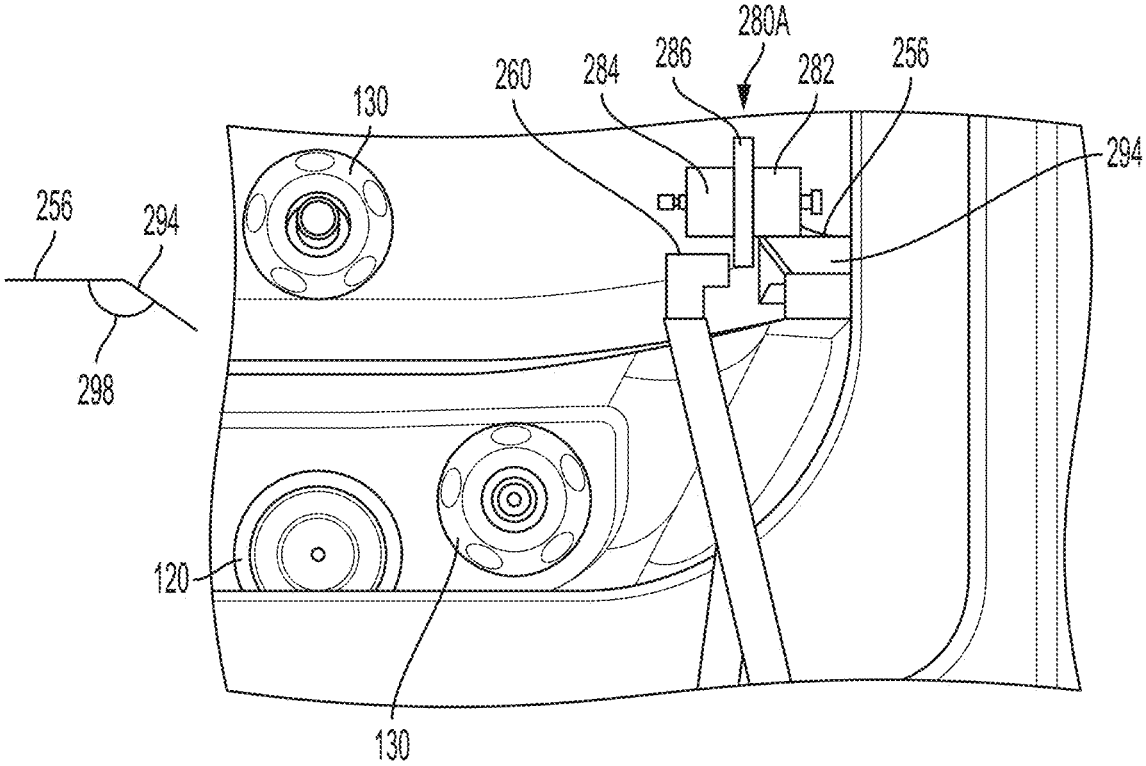
FIG. 9 illustrates a front view of the tub of FIG. 1A with the carrier base of FIG. 1B docked to the tub.

Referring to FIGS. 7-9, the carrier base 204 may include a first arm 260 and a second arm 262. The first arm 260 may be opposite to the first arm 260. When the transfer system is engaged to the tub 102, the first arm 260 may extend into the tub 102 and may be adjacent to the first support surface 256. The second arm 262 may also extend into the tub 102 and may be adjacent to the second support surface 258. The first arm 260 may be closest to the first support surface 256 than to the second support surface 258, whereas the second arm 262 may be closest to the second support surface 258 than to the first support surface 256.

As seen in FIG. 7, the first arm 260 extends adjacent to (e.g., overlaps with) the first support surface 256 over a first overlap distance 264. The second arm 262 extends adjacent to (e.g., overlaps with) the second support surface 258 over a second overlap distance 266. The overlap between the first support surface 256 and the first arm 260 and the second support surface 258 and the second arm 262 may provide a transfer experience that may be more secure, safe and comfortable for the patient.

In advantageous embodiments, the first arm 260 may be generally at the same vertical level as the first support surface 256. The second arm 262 may be generally at the same vertical level as the second support surface 258. Alternatively, the first arm 260 may be at a different vertical level from the first support surface 256. The second arm 262 may be at a different vertical level from the second support surface 258. In certain aspects, the first arm 260 and the second arm 262 may generally be at the same vertical level as each other. Alternatively, the first arm 260 and the second arm 262 may be at different vertical levels. An embodiment in which the first arm 260 and the second arm 262 are each generally at the same vertical level as each other, and at the same vertical level as the first support surface 256 and/or the second support surface 258 may improve the transfer experience for the patient by providing a smooth transfer.

In some illustrative embodiments, the first overlap distance 264 may equal between about 10% and about 50% of a depth 268 of the first arm 260. Further, the second overlap distance 266 may equal between about 10% and about 50% of a depth 270 of the second arm 262. In certain optional embodiments, the first arm 260 and the second arm 262 may be of equal depths. Accordingly, the first overlap distance 264 and the second overlap distance 266 may be equal to each other in some such embodiments. By providing a substantial overlap distance, the transfer system may reduce the chances of poor engagement of transfer system components to the tub 102, and may reduce the chances of inadvertently causing injury to the patient during transfer.

With continued reference to FIGS. 7 and 9, the transfer system may include a plurality of wheels 280A-D operatively coupled to the transfer seat 202. The plurality of wheels 280A-D may facilitate relative slidable movement between the transfer seat 202 and the carrier base 204 of the transfer system in the condition when the transfer system is engaged with the tub 102, as will be described further below. As seen from FIGS. 7 and 9, the plurality of wheels 280A-D includes a first wheel 280A, a second wheel 280B, a third wheel 280C and a fourth wheel 280D. While four wheels are illustrated, additional or fewer wheels are contemplated within the scope of the present disclosure.

As may be appreciated from FIGS. 7 and 9, the wheels 280A-D of the transfer seat 202 may roll relative to the first support surface 256 and the second support surface 258 of the tub 102, as will be described further below. In certain advantageous aspects, the wheels 280A-D, the first support surface 256 and the second support surface 258 may each have significantly low coefficient of friction to facilitate ease of movement even when transferring bariatric residents. Materials that may be suitable include nylon (66), UHMW-PE, acetal (Delrin). In such cases, the transition from the transfer seat 202 to the tub 102 may be imperceptible by the resident.

The first wheel 280A may have a first surface 282. The first wheel 280A may also have a second surface 284. The first surface 282 and the second surface 284 may be exterior (e.g., cylindrical) surfaces of the first wheel 280A. The first surface 282 and the second surface 284 may be spaced apart, for instance, by a first spacer 286. The first spacer 286 may optionally align (horizontally and/or vertically) the carrier base and/or transfer seat with the first support surface. During transfer of the patient (e.g., from or to the tub 102 after the carrier base 204 has been docked to the tub 102), the first surface 282 may contact the first arm 260 and the second surface 284 may contact the first support surface 256. In some advantageous embodiments, as a result of the extension of the first arm 260 and the first support surface 256 over the first overlap distance 264, the first surface 282 may contact the first arm 260 simultaneously when the second surface 284 may contact the first support surface 256. The simultaneous contact between the first surface 282 and first arm 260, and the second surface 284 and the second arm 262 may occur as the first wheel 280A has rolled until a proximal end of the first arm 260.

The second wheel 280B may have a third surface 288. The second wheel 280B may also have a fourth surface 290. The third surface 288 and the fourth surface 290 may be exterior (e.g., cylindrical) surfaces of the second wheel 280B. The third surface 288 and the fourth surface 290 may be spaced apart, for instance, by a second spacer 292. The second spacer may optionally align (horizontally and/or vertically) the carrier base and/or transfer seat with the second support surface. The first and the second spacers may each also align the transfer seat (horizontally and/or vertically) to the first arm and the second arm respectively of the carrier base, when transferring the transfer seat out of the tub. During transfer of the patient (e.g., from or to the tub 102), the third surface 288 may contact the second arm 262 and the fourth surface 290 may contact the second support surface 258. In some advantageous embodiments, as a result of the extension of the first arm 260 and the first support surface 256 over the first overlap distance 264, the first surface 282 may contact the first arm 260 simultaneously when the second surface 284 may contact the first support surface 256. The simultaneous contact between the third surface 288 and second arm 262, and the fourth surface 290 and the third arm may occur as the second wheel 280B has rolled until a proximal end of the second arm 262.

In various optional aspects, the first support surface 256 and the second support surface 258 may be contoured such that small misalignment between the carrier base 204 and the tub 102 may not lead to reduced safety or discomfort during transfer. For example, as illustrated in FIGS. 7 and 9, the first support surface 256 may include a first tapered leading surface 294 that may taper generally in a vertical direction. Further, in additional optional embodiments, the second support surface 258 may also include a second tapered leading surface 296 that may taper generally in a vertical direction. If, for instance, the carrier base 204 is docked such that the first arm 260 is not at the same vertical level as the first support surface 256, the generally vertical tapering of the first tapered leading surface 294 may facilitate engagement of the second surface 284 of the first wheel 280A to the first support surface 256. Similarly, if, for instance, the carrier base 204 is docked such that the second arm 262 is not at the same vertical level as the second support surface 258, the tapering of the second tapered leading surface 296 may facilitate engagement of the fourth surface 290 of the second wheel 280B to the second support surface 258.

In some optional embodiments, the first tapered leading surface 294 may form an angle 298 between about 120 degrees and about 180 degrees with respect to the first support surface 256, for instance, about 150 degrees. In further optional embodiments, the second tapered leading surface 296 may form an angle between about 120 degrees and about 180 degrees, for instance, about 150 degrees. Such advantageous positioning and orientation of the first tapered leading surface 294 and the second tapered leading surface 296 may accommodate mismatched heights of the tub 102 and the carrier base 204 and under practical circumstances, reduce the chances of needing mechanical adjustments to assure adequate vertical alignment of the carrier base 204 and tub 102.

Position Locking

As mentioned previously, the transfer seat 202 may be lockable with respect to the carrier base 204 to limit relative motion between the transfer seat 202 and the carrier base 204 prior to engagement of the transfer system and the tub 102. According to certain embodiments, the transfer system may include one or more locks as will be described further with reference to FIGS. 10-16.

Figure 10:
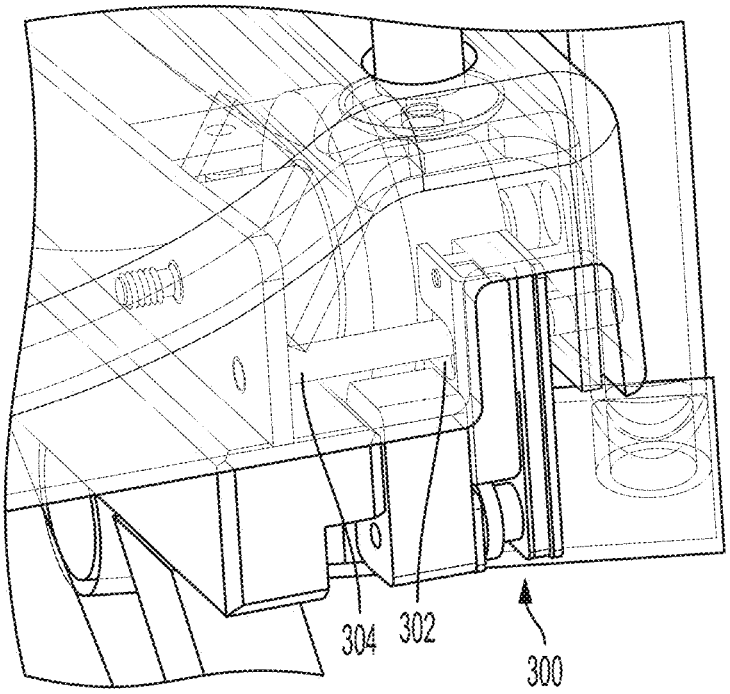
FIG. 10 illustrates an enlarged perspective view of a first lock of the transfer system according to an embodiment shown in a locked state.
Figure 11:
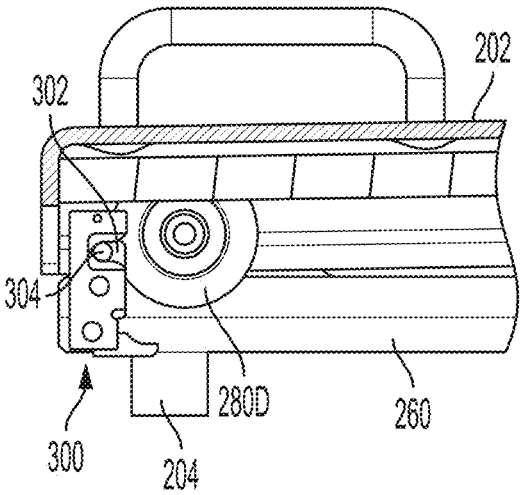
FIG. 11 illustrates a side view of the first lock of FIG. 10 shown in a locked state.
Figure 12:
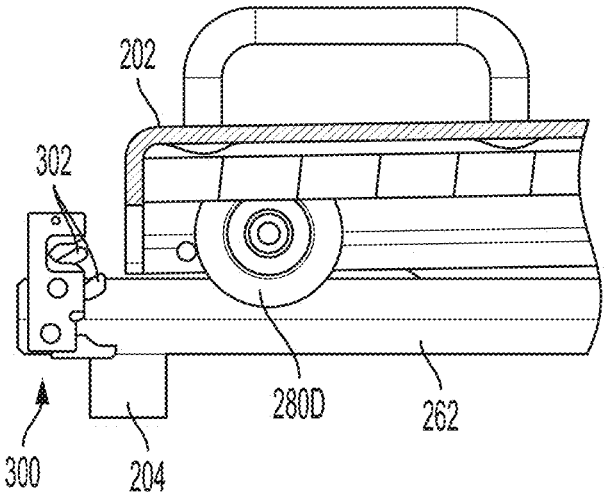
FIG. 12 illustrates a side view of the first lock of FIG. 10 shown in an unlocked state.

As shown in FIGS. 10-12, the transfer system may include a first lock 300. The first lock 300 may lock the transfer seat 202 to the carrier base 204 and thereby limit the relative motion between the transfer seat 202 and the carrier base 204 prior to engagement of the transfer system and the tub 102. The first lock 300 may be any type of commonly known mechanical or electronic (or a combination thereof) locks. For instance, in one embodiment (as illustrated), the first lock 300 may be similar to the tub lock 252. As shown in FIGS. 11 and 12 the first lock 300 may include a pair of spring-biased jaws 302. The spring-biased jaws may be provided on the carrier base 204 in some embodiments. In such embodiments, a first locking pin 304 may be provided on the transfer seat 202. Alternatively, the spring-biased jaws 302 may be provided on the transfer seat 202, and the first locking pin 304 may be provided on the carrier base 204. The spring-biased jaws 302 may be actuated (e.g., mechanically by a caregiver, automatically, etc.) to capture the first locking pin 304, and thereby lock the carrier base 204 with respect to the transfer seat 202. In one example, actuation of the spring-biased jaws 302 to capture the first locking pin 304 may be accomplished by the first locking pin 304 bearing against the surface of the jaws 302 (e.g., in a manner similar to actuation of a car door latch). Alternatively, the actuation of the spring-biased jaws 302 may be accomplished by other mechanical or electronic systems, or a combination thereof. Once locked, the transfer seat 202 may not have relative motion with respect to the carrier base 204.

Figure 13:
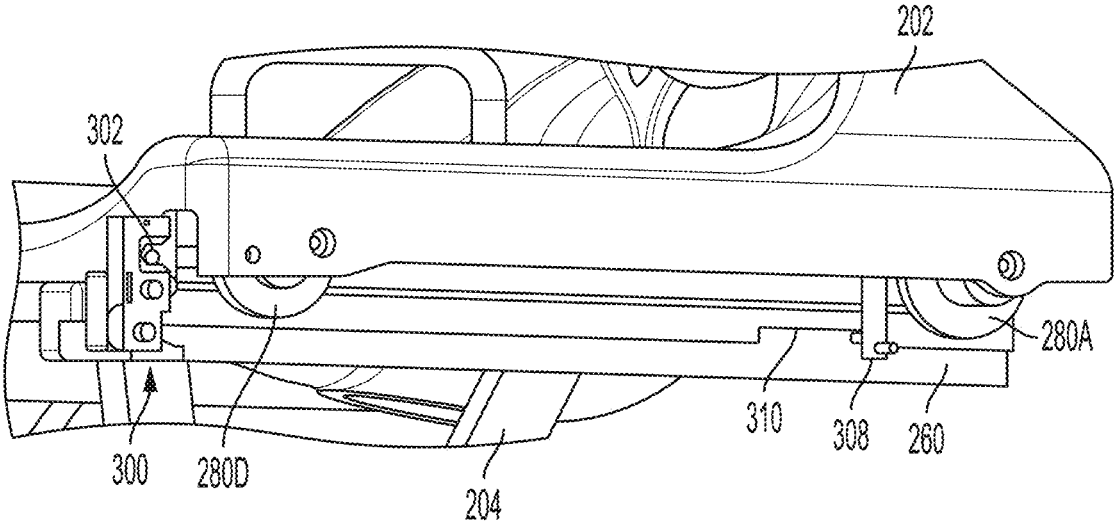
FIG. 13 illustrates a bottom perspective view of a second lock according to an embodiment shown in a locked state.

In certain aspects, the transfer system may include a second lock. The second lock may enhance safety during transportation of the patient. The second lock may be any type of mechanical or electronic (or a combination thereof) lock. For instance, as illustrated in FIGS. 13-16, in one embodiment, the second lock may include a second locking pin 308. The second locking pin 308 may be provided on the transfer seat 202 in some embodiments. In such embodiments, the carrier base 204 may include one or more indents 310 to capture the second locking pin 308. Alternatively, the second locking pin 308 may be provided on the carrier base 204 and the transfer seat 202 may include one or more indents 310. In the illustrated embodiment, as shown in FIG. 13, the second locking pin 308 extends from a bottom portion of the transfer seat 202 toward the carrier base 204. When the second locking pin 308 abuts the indent 310, the second locking pin 308 may be captured within the indent 310 of the carrier base 204 to restrict relative motion between the carrier base 204 and the transfer seat 202.

Figure 14:
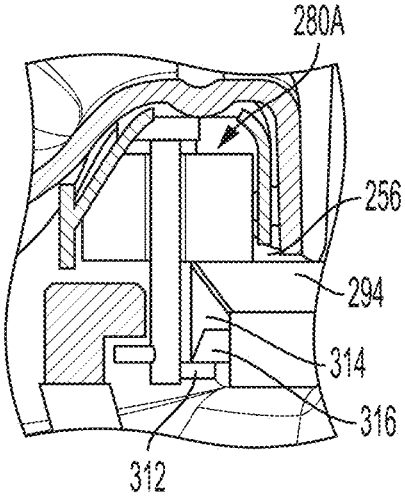
FIG. 14 illustrates a front view of the second lock of FIG. 13 during transfer of the transfer seat into the tub.

With continued reference to FIGS. 13 and 14, the second locking pin 308 may include a transverse pin 312. Certain surfaces of the transfer system and/or the tub 102 may bear on the transverse pin 312 to maintain the second locking pin 308 in an extended, unlocked stated during transfer of the patient, as will be described further below. As shown in FIG. 14, the first support surface 256 of the tub 102 may include a contoured portion 314. The contoured portion 314 may have a bottom surface 316 that may abut the transverse pin 312 during transfer. Further, bearing of the bottom surface 316 may lead to the second locking pin 308 to disengage the indent 310 to automatically unlock the transfer seat from the carrier base when the carrier is docked to the tub, thus enabling transfer. While not illustrated in FIG. 14, the second support surface 258 of the tub 102 may also include a similar contoured portion.

Figure 15:
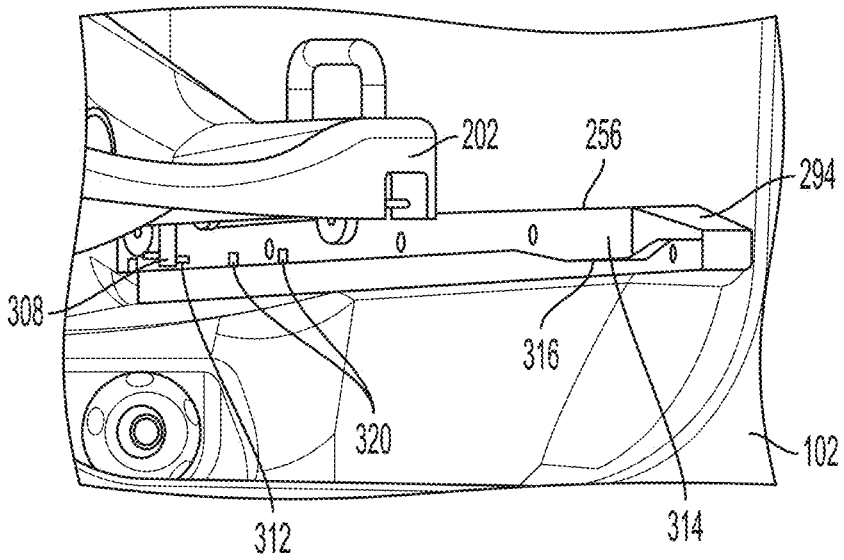
FIG. 15 illustrates a bottom perspective view of the second lock of FIG. 13 locked into an indent of the first support surface.
Figure 16:
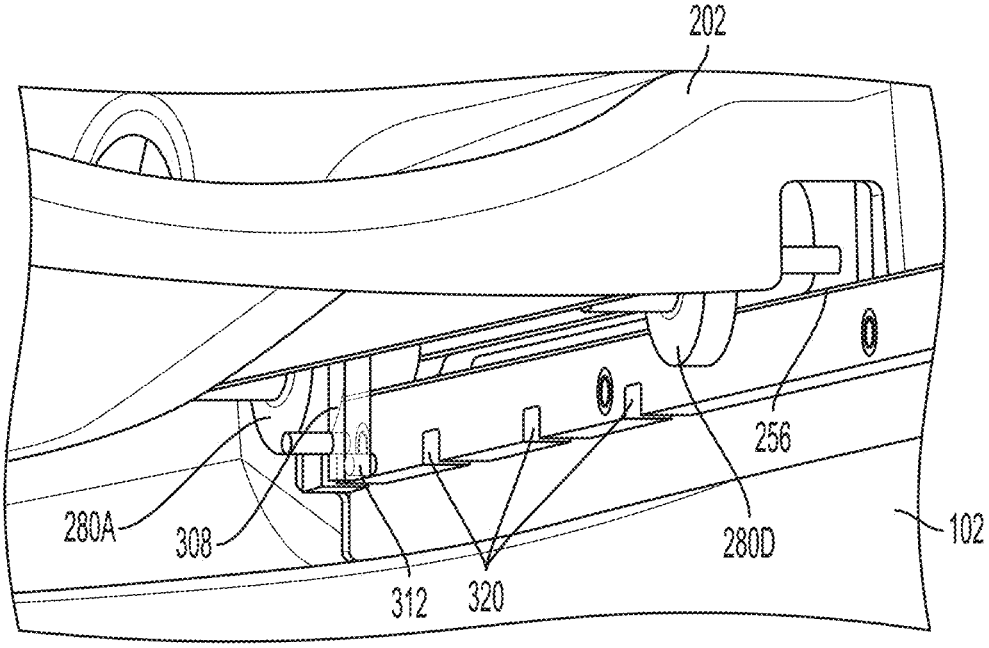
FIG. 16 illustrates a bottom perspective view of the second lock of FIG. 13 locked into an indent of the first support surface.

Referring now to FIGS. 15 and 16, the first support surface 256 may also include one or more indents 320 (e.g., opposite to the portion contacting the wheels 280A, which may cooperate with the second locking pin 308 to lock the transfer seat 202 relative to the tub 102, and thereby restrict relative motion between the transfer seat 202 and the tub 102. For instance, the first support surface 256 may include one or more indent(s) 320. The indent(s) 320 may capture the second locking pin 308 to lock the transfer seat 202 with relative to the tub 102, and thereby restrict relative motion between the transfer seat 202 and the tub 102. When the transverse pin 312 encounters at least one of the indents 320, the second locking pin 308 may be actuated (e.g., manually or automatically) to retract into the indent 320, and thereby by captured within the indent 320. While not illustrated in FIGS. 15 and 16, the second support surface 258 of the tub 102 may also include indent(s) similar to the indent(s) 320. As will be described further below, the deactivation of the first locking pin 304 and/or the second locking pin 308 may be accomplished automatically via electrical controls by a control system upon determination that the system is in a state where it is permissible to transfer a patient.

Control System

According to certain advantageous aspects of the present disclosure, several of the mechanical components described herein may be electronically actuated and/or computer controlled. FIG. 1C is a schematic that illustrates one such embodiment. In such cases, as shown in FIG. 1C, aspects of the disclosure may include a controller 400 to control the operation of various components of the bathing system 100. The controller 400 can be a programmable motor controller 400, a programmable computer such as a microprocessor, a programmable logic controller 400, and the like, and may include (and/or be in communication with) on-board or remote non-transitory storage media for storing instructions in the form of algorithms and/or data. The controller 400 may also be application specific integrated circuits (ASICs), microcontrollers, microprocessors, field-programmable gate arrays (FPGAs), or any other appropriate structure capable of receiving and processing data, as well as, circuitry distributed across a network to receive and process data and control system operation as described herein from a remote location. In aspects of the present disclosure, the controller 400 may receive electrical signals from one or more sensors described herein and can execute one or more control algorithms disclosed herein.

Sensors

In some illustrative examples, the bathing system 100 may include one or more sensors for sensing various attributes or properties of (or relating to) the bathing system 100 and generating corresponding signals representative thereof. The controller 400 may be in operative (e.g., wired or wireless) communication with the sensors and may receive signals generated by the sensors. The controller 400 may perform one or more control algorithms that may change one or more physical properties of the bathing system 100, and/or may display an output on a display 410. In some such advantageous aspects, the bathing system 100 may include a display 410. The display 410 may include a touchscreen to allow a user (e.g., caregiver) to interact with the control system, and/or view outputs or instructions displayed by the control system.

According to an example embodiment, the sensors may include a first sensor 412. The first sensor 412 may sense a position of a first component of the tub 102 or a second component of the transfer system. For instance, in one embodiment, the first sensor 412 may be a proximity sensor.

Further, in some such cases, the first sensor 412 may be provided on the tub 102. In such cases, the second component of the transfer system that may be sensed by the first sensor 412 may include a portion of the carrier base 204. Accordingly, in such embodiments, the first sensor 412 may sense whether the carrier base 204 is within a predetermined distance and generate a first signal 412S. Alternatively, the first sensor 412 (e.g., proximity sensor) may be provided on the carrier base 204. In such cases, the first sensor 412 may sense whether the carrier base 204 has been moved to within the predetermined distance. In alternative embodiments, the first sensor 412 may measure a relative position or the distance between a portion of the tub 102 and a portion of the carrier base 204, and the first signal 412S may simply correspond to the distance between the portion of the tub 102 and the portion of the carrier base 204. Still further, the first sensor 412 may measure an absolute position of each of the portion of the tub 102 and the portion of the carrier base 204 and the first signal 412S may correspond to the measured absolute positions.

In illustrative embodiments, the portion of the tub 102 and the portion of the carrier base 204 may be the tub lock 252 described herein. For instance, in embodiments where the tub 102 includes a latch and the carrier base 204 includes a carrier pin 250, the first sensor 412 (e.g., a proximity sensor) sense a distance between the carrier pin 250 and the latch and generate the first signal 412S. In additional embodiments, the first sensor 412 may sense whether the distance between the carrier pin 250 and the latch is less than a threshold distance. In some such embodiments, if the distance between the carrier pin 250 and the latch is less than the threshold distance, the first sensor 412 (e.g., proximity sensor) may generate a first signal 412S. The threshold distance may be set to any suitable value. For instance, in one embodiment, the threshold distance may be set to zero, which may correspond to the carrier pin 250 being captured in the latch, and the tub lock 252 being in a "locked" state. Such embodiments may facilitate the controller 400 in deciding whether the carrier base 204 is engaged to the tub 102 and is in a docked and/or "ready" state (e.g., for facilitating safe transfer of a patient into or out of the tub 102).

In certain embodiments described above, the transfer seat 202 may be lockable with respect to the carrier base 204 by at least one lock. For instance, a first lock 300 and a second lock may be provided to lock the transfer seat 202 with respect to the carrier base 204. In such embodiments, a second sensor 414 may be in operative communication with the first lock 300 and/or the second lock. In one example, the first lock 300 and/or the second lock may be mechanically actuable as described with reference to FIGS. 5 and 6. In such cases, the second sensor 414 may also be a proximity sensor, and as was the case with the first sensor 412 sense one or more quantities (absolute position, relative position, distance, etc.) and generate a second signal 414S. In another example, the first lock 300 and/or the second lock may be electronically actuable and may include, for example, an electric circuit and/or a solenoid.

According to some embodiments, the tub 102 may include a tub door 170 that may move between an open position and a closed position. The tub door 170 may be in the open position during transfer of the transfer seat 202 into the tub 102. In such embodiments, a third sensor 416 may sense physical properties that may facilitate determination of whether the tub door 170 is in the open position or in the closed position. For instance, if the tub door 170 is in the open position, the third sensor 416 may generate a third signal 416S. If the tub door 170 is in the closed position, the third sensor 416 may generate a fourth signal 418S. In one example, the third sensor 416 can also be a proximity sensor, and may be provided either on the tub door 170 or elsewhere on the tub 102, and may detect one or more quantities (absolute position, relative position, distance, etc.) and generate the third or fourth signals. Alternatively, in some embodiments, the tub door 170 and/or portions of the tub 102 may include electric circuitry (e.g., electrical contacts) which may be generate an electric signal when the tub door 170 is closed and another electric signal when the tub door 170 is open. The third sensor 416 may use the electric signals of the electric circuitry of the tub door 170 and generate the third or the fourth signal 418S. Additionally, an additional proximity sensor may monitor whether the transfer seat has fully transferred into or out of the tub.

According to illustrative embodiments, a fourth sensor 420 may sense a level of liquid in the tub 102 and generate a fifth signal 420S. Such embodiments may provide a variety of information, such as whether a level of liquid (e.g., water and/or bathing product and/or skin care product and/or hydrotherapy product during use) in the tub 102 is above permissible levels, whether a level of liquid in the tub 102 is sufficient to ensure operation of components of a fluid agitation system 122 (e.g., a whirlpool system or an air spa system) and the like. In further optional embodiments, the fourth sensor may sense whether a maximum liquid capacity reached, thereby conserving liquids and reducing wastage thereof, whether a liquid level is sufficiently high to allow rapid filling from the pre-fill tank while simultaneously leading to reduced splashing and noise, and the like.

In various embodiments, additional or alternative sensors may be provided to sense additional physical properties. For instance, a fifth sensor 422 may sense a level of a cleaning solution (e.g., detergent, disinfectant such as quaternary disinfectant, sanitizer, etc.) in the tub 102 during a cleaning operation. In further exemplary embodiment, a sixth sensor 424 may sense a temperature of a liquid in the tub 102.

In additional embodiments, the controller may interface with remote control buttons or switches such as a button position near the tub door to enable release of the carrier base to tub lock. The controller may interface with the tub lock to effect electronic release. A similar system may be used to provide a button control of the tub door with a solenoid actuated door lock system.

Control Algorithms

Figure 17B:
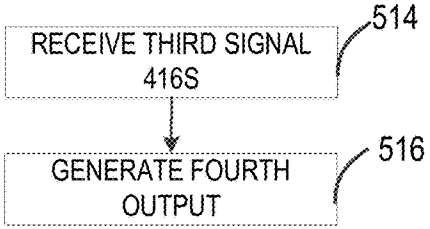
FIGS. 17A, 17B, 17C and 17D illustrates exemplary control algorithms.
Figure 17A:
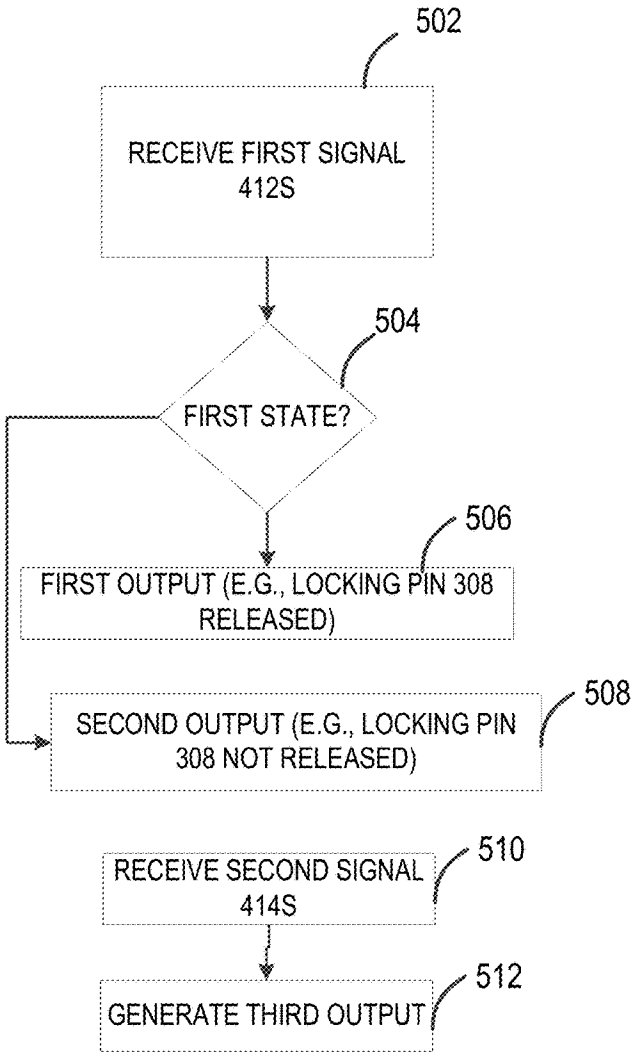
Figure 17D:
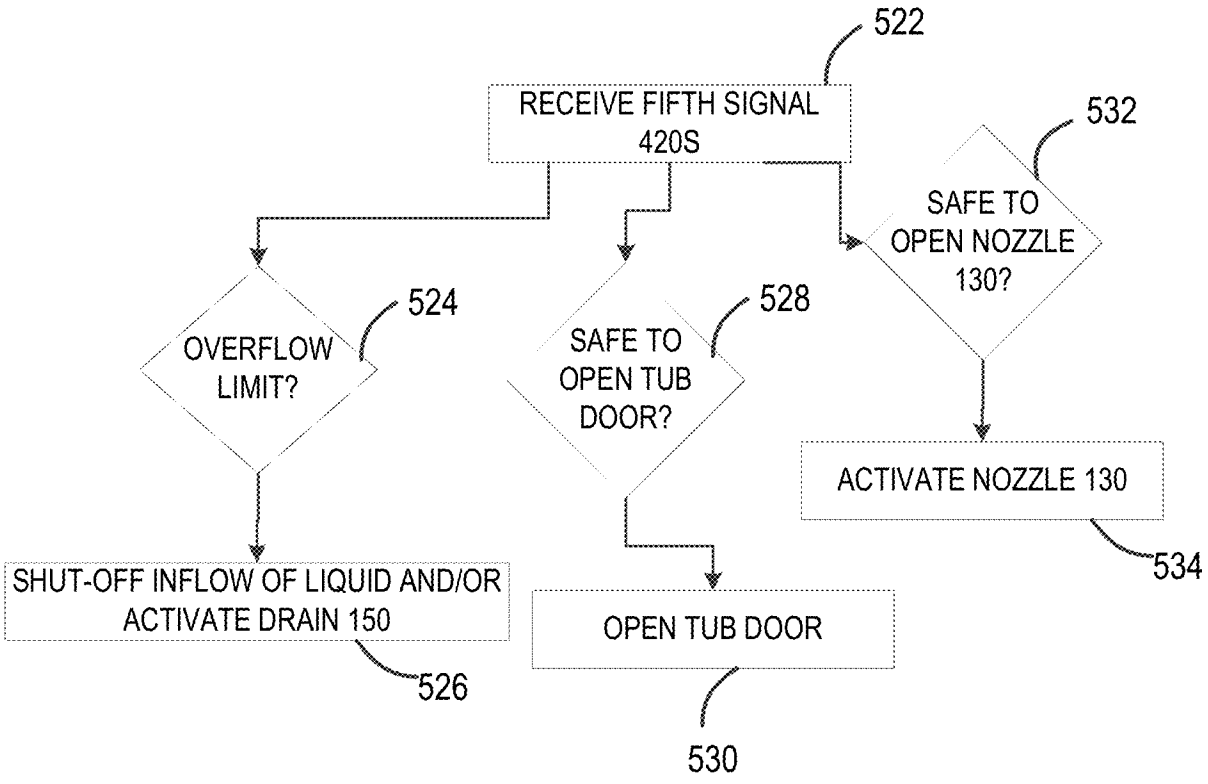

FIG. 17A illustrates an exemplary control algorithm that may be performed by the controller 400 based on the signals received from the sensors illustrated in FIG. 1C. In FIG. 17A, several optional steps are indicated with boxes shown by dotted lines. FIG. 17A illustrates a first control algorithm regarding transfer via the transfer system. At step 502, the controller 400 receives the first signal 412S generated by the first sensor 412. At step 504, the controller 400 determines whether the first signal 412S corresponds to a first state where it is permissible to transfer the transfer seat 202 toward or away from the tub 102 or a second state where it is impermissible to transfer the transfer seat 202 toward or away from the hub. In one example, the first state may correspond to the carrier base 204 being docked to the tub 102. In another example, the first state may correspond to the carrier pin 250 being captured in the tub lock 252. In a further example, the second state may correspond to the carrier base 204 being undocked relative to the tub 102. In a further example, the second state may correspond to the carrier pin 250 being not captured in the tub lock 252. In a further example, the second state may correspond to the carrier base 204 being positioned outside the threshold distance relative to the tub 102.

If the controller 400 determines that the first signal 412S corresponds to the first state where it is permissible to transfer the transfer seat 202 toward or away from the tub 102, the controller 400 may generate a first output at step 506. If the controller 400 determines that it is not permissible to transfer the transfer seat 202 toward or away from the tub 102, the controller 400 may generate a second output at step 508.

In some embodiments, the carrier base 204 and the transfer seat 202 may include a first lock 300 and/or a second lock that may include electronic components (e.g., a solenoid). In such embodiments, the first output may be an electric signal that may deactivate the electronic components to automatically release the first lock 300 and/or the second lock, thereby permitting the relative motion between the carrier base 204 and the transfer seat 202. In such embodiments, the step of determining whether the signal corresponds to a first state where it is permissible to transfer the transfer seat 202 toward or away from the tub 102 prior to unlocking the first lock 300 and/or the second lock may ensure additional safety, and reduce the chances of injury to the patient being transferred.

In additional or alternative embodiments, the first lock 300 and/or the second lock may be manually actuable. In such embodiments, the first output may be in the form of an instruction (e.g., text, picture, audio, video, animation, etc.) that would permit manually unlocking the first lock 300 and/or the second lock. For instance, the first output may be a visual indication (e.g., a green checkmark on the display 410), which may indicate that the bathing system 100 is in a "ready" state. The first lock 300 and/or the second lock may then be manually released (e.g., by pressing the handle 220 of the transfer seat 202, by bearing the second locking pin 308 against the spring-biased jaw, etc.) thereby facilitating relative movement between the carrier base 204 and the transfer seat 202.

In the embodiments where the carrier base 204 and the transfer seat 202 may include a first lock 300 and/or a second lock that may include electronic components (e.g., a solenoid), the second output may be an electric signal that may actuate the electronic components to maintain the first lock 300 and/or the second lock in a locked state, thereby restricting the relative motion between the carrier base 204 and the transfer seat 202. Such embodiments may permit the transfer of a patient not to occur under conditions that may be unsafe for the patient.

In some embodiments, the first signal 412S may be directly representative of the tub 102 and the carrier base 204 being docked, and the carrier pin 250 being captured. In such embodiments, the receipt of the first signal 412S by the controller 400 may be sufficient for the controller 400 to determine that the bathing system 100 is in the first state (transfer of patient permitted). In such embodiments, in the absence of the first signal 412S, the controller 400 determines that the bathing system 100 is in the second state (transfer of patient restricted). Such embodiments may ensure that the transfer of a patient takes place only when the controller 400 has received the first signal 412S from the first sensor 412.

In some optional embodiments where the transfer system includes a first lock 300 and a second lock, as described above, the bathing system 100 may include a second sensor 414 in operative communication with the first lock 300 and/or the second lock. In such cases, the second sensor 414 may generate a second signal 414S. In such cases, the controller 400 may be in operative communication with the second sensor 414. Referencing FIG. 17A, at optional step 510, the controller 400 may receive the second signal 414S generated by the second sensor 414. Upon receipt of the second signal 414S, the controller 400 may, at step 512, generate a third output. In some such embodiments, the third output may (similar to the first and/or second outputs) be displayed on the display 410 of the bathing system 100 in the form of instructions (e.g., text, picture, audio, video, animation, etc.) or an electric signal to control one or more of the first lock, and/or the second lock so as to not release.

In certain optional embodiments, the tub 102 may include a tub door 170 that may move between an open position and a closed position. In such cases, the tub door 170 may be in the open position during transfer of the transfer seat 202 into the tub 102. As mentioned above, in such optional embodiments, a third sensor 416 may be provided to sense whether the tub door 170 is in the open position, and generate a third signal 416S if the tub door 170 is in the open position. The controller 400 may be in operative communication with the third sensor 416. Referencing FIG. 17B, at optional step 514, the controller 400 may receive the third signal 416S generated by the third sensor 416. At step 516, the controller 400 may generate a fourth output. In certain advantageous embodiments, the fourth output may be displayed on the display 410 of the bathing system 100 in the form of instructions (e.g., text, picture, audio, video, animation, etc.) or an electric signal (e.g., to control one or more of the first lock, and/or the second lock).

In advantageous aspects, the controller 400 may generate a single output that combines one or more of the first, third and fourth outputs. For instance, the first output may represent that the tub 102 and the carrier base 204 have docked. The third output may represent a condition where the first lock of the transfer seat 202 and the carrier base 204 is in an unlocked state. The fourth output may represent a condition where the tub door 170 is open. In addition to, or instead of generating each of the first, third, and fourth outputs, the controller 400 may, in the alternative, generate a single output. The single output may be in the form of instructions (e.g., "Ready to transfer.") In the alternative, single output may be an electric signal, which may, for instance, deactivate the electronic components to automatically release the second lock, thereby permitting the relative motion between the carrier base 204 and the transfer seat 202. Such embodiments may advantageously provide multiple sensor outputs that may have to be verified by the controller, prior to releasing the transfer seat 202 for transfer, thereby ensuring that transfer of a patient takes place under safe conditions.

Further advantageous embodiments may involve combining the outputs of one or more sensors to determine if there are additional faults associated with the transfer system that may indicate that the transfer system is in a condition not suitable for transfer. If for instance, the first sensor indicates the tub lock 252 is in a closed position (corresponding to a condition where the carrier base may be docked) but an additional proximity sensor indicates that the carrier pin 250 is not detected, the controller may determine from a combination of two (or more) sensor outputs that the tub lock may have been accidently closed. Alternatively, the carrier pin 250 is detected by the first sensor at a location near or within the tub lock, but if an additional sensor indicates that the tub lock is not in a closed position, the controller may determine from a combination of two (or more) sensor outputs that the tub lock may be malfunctioning. The controller may instruct a caregiver to initiate a mechanical or manual inspection to resolve one or more of such fault conditions. Alternatively, or in addition, the controller may not activate components of the transfer system to be in a state that permits transfer, as will be described further below.

Figure 17C:
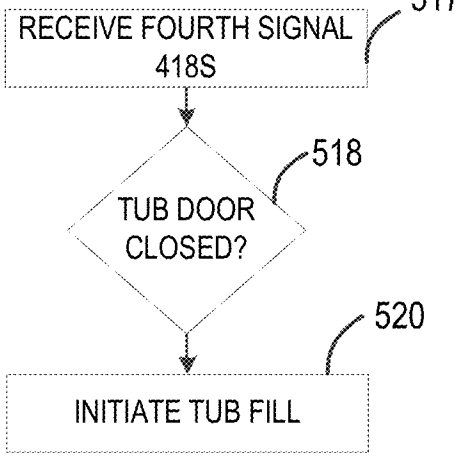

The third sensor 416 may generate a fourth signal 418S if the tub door 170 is in the closed position. Referring to FIG. 17C, at optional step 517, the controller 400 may receive the fourth signal 418S, and at optional step 518, the controller 400 may determine, based on the fourth signal 418S whether the tub 102 is in a state so as to be filled with liquids. For instance, as mentioned previously, the fourth signal 418S may represent whether the tub door 170 is closed. Accordingly, when the controller 400 determines that the tub door 170 is closed, the controller 400 may, at step 520, initiate a tub fill operation. In some such advantageous aspects, the tub fill may be initiated by the controller 400 by communicating (e.g., via wired or wireless circuits) with one or more tub fill valves 140 (as seen in FIG. 1C) that may be in fluid communication with the liquid source 118. The controller 400 may electronically actuate the one or more tub fill valves 140, in turn filling the tub 102 with the liquid (e.g., water, and/or bathing product and/or hydrotherapy product, and/or skin care product).

In advantageous aspects, the communication between the controller 400 and one or more tub fill valves 140 may ensure that the tub 102 is not filled (e.g., beyond a predetermined depth, or at all), in the event that the tub door 170 is open. Accordingly, if the controller 400 receives the third signal 416S from the third sensor 416, the controller 400 may not actuate the one or more tub fill valves 140. Alternatively, the controller 400 may deactivate the tub fill valves 140 when the level of liquid in the tub 102 is greater than a predetermined level.

As mentioned previously, in certain optional embodiments, a fourth sensor 420 may sense a level of liquid in the tub 102 and generate a fifth signal 420S. In such embodiments, referencing FIG. 17D, optionally, the controller 400 may receive the fifth signal 420S at step 522 and determine one or more states of the bathing system 100. For instance, the controller 400 may, at optional step 524, determine whether a level of liquid in the tub 102 is greater than an overflow limit. If the controller 400 determines the level of liquid exceeds the overflow limit, the controller 400 may, at optional step 526, shut off the inflow of liquid (e.g., by communicating with the inlet ports). Optionally, the controller may activate (e.g., via a wired or wireless electric signal) a drain 150 or components thereof (e.g., an electronic valve 152 fluidly communicating with the tub 102 and the drain 150) to drain the liquid in the tub 102 until the level of the liquid in the tub 102 generally equals or is generally less than the overflow limit.

Additionally or alternatively, the controller 400 may receive the fifth signal 420S and determine, at optional step 528 whether a level of liquid in the tub 102 corresponds to a level where it may be safe to open the tub door 170 without resulting in leakage of liquid from the tub 102, and if so, actuate electronic controls to automatically open the door at optional step 530. Alternatively, in such cases, the controller 400 may display an output on the display 410 indicating that the tub door 170 may be safely opened.

In certain optional embodiments, the bathing system 100 may include a fluid agitation system 122 (e.g., a whirlpool system or an air spa system) with one or more nozzles 130. In such cases, referring back to FIG. 17C, at optional step 522, the controller 400 may receive the fifth signal 420S and determine, at step 532 whether the tub 102 is in a state (e.g., liquid level is sufficiently high) so as to actuate the one or more nozzles 130, and if so, at optional step 534 actuate the one or more nozzles 130. Alternatively, if the controller 400 determines that the tub 102 is in a state (e.g., liquid level is not sufficiently high) to not actuate the one or more nozzles 130, the controller 400 may prevent actuation of the one or more nozzles 130, or may not actuate the one or more nozzles 130.

In some such embodiments, the controller 400 may actuate the nozzles 130 directly, e.g., by sending electrical signals to an electric circuitry in operative communication with the nozzle(s). Alternatively, the controller 400 may actuate the nozzles 130 indirectly, e.g., by sending electrical signals to an electric circuitry of another component (e.g., whirlpool pump 132) in operative communication with the nozzle(s).

Additional or alternative embodiments may involve control of additional or alternative components of the bathing system via the controller. According to an embodiment, the controller may automatically regulate temperature of the liquid. For instance, the controller may be in operative communication with a temperature sensor (thermocouple) to sense the temperature of liquid, and regulate the temperature thereof to be within predefined limits.

According to another aspect, the controller may automatically initiate cleaning and disinfecting operations, for instance, according to predefined programs. The controller may initiate one or more cleaning and/or disinfecting operations, and may dispense appropriate quantities of cleaning solutions and/or disinfectants in the desired concentrations.

Figure 18:
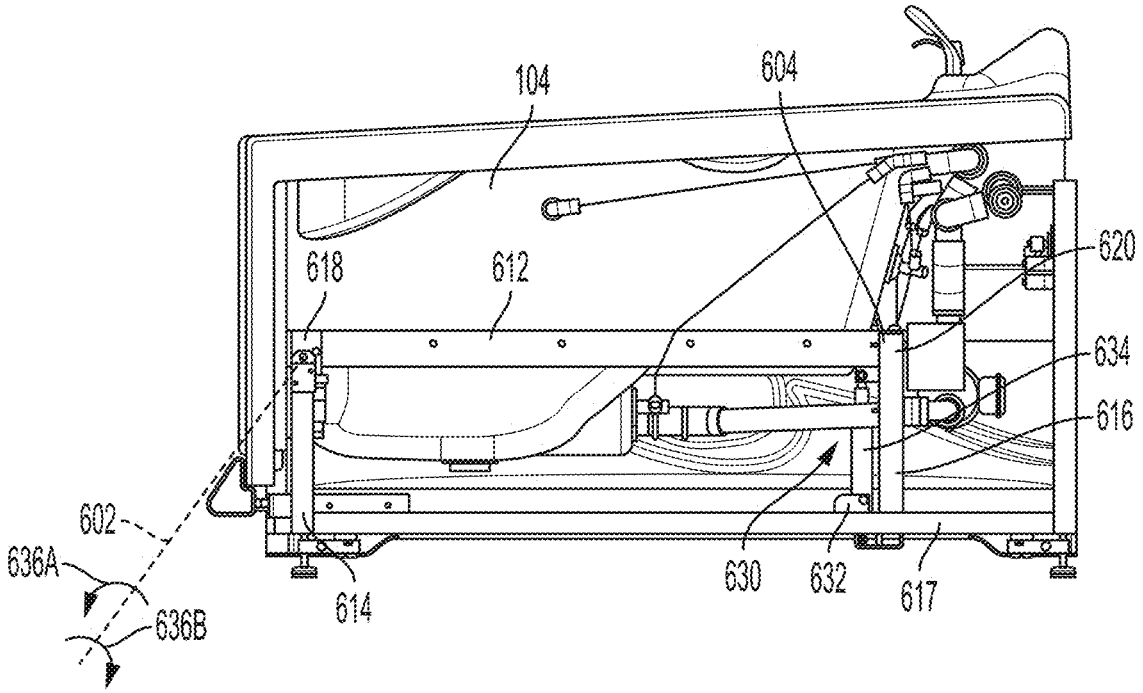
FIG. 18 illustrates a side view of the bathing system of FIG. 1A with the tub chamber in a transfer position according to an embodiment.
Figure 19:
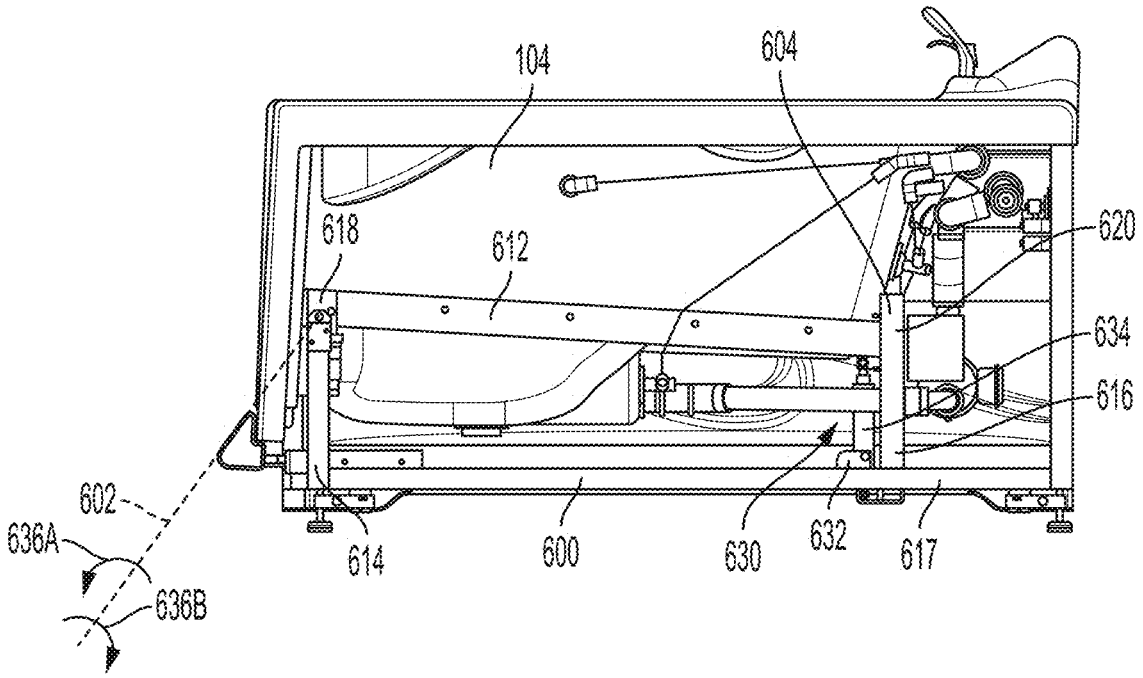
FIG. 19 illustrates a side view of the bathing system of FIG. 18 with the tub chamber in an immersed position according to an embodiment.

FIGS. 18-19 illustrate a bathing system 100 according to additional or alternative embodiments. In some such embodiments, the tub chamber 104 may be raised and/or lowered with respect to a frame 600 that supports the tub chamber 104. Advantageously, the raising and/or the lowering of the tub 102 may facilitate patient transfer, and/or may be suitable for an immersion hydrotherapy procedure.

FIG. 18 illustrates the tub chamber 104 in the transfer position while FIG. 19 illustrates the tub chamber 104 in the immersed position. In the transfer position, the tub may be at a level suitable for transfer of a patient via a transfer system such as those disclosed herein. The immersed position may be suitable for providing deeper immersion of the patient to facilitate hygiene, hydrotherapy and/or more coverage or dignity for residents. In the immersed position, the tub chamber 104 may be lower near the rear (e.g., near end 620) than near end (618).

As seen in FIGS. 18-19, the tub chamber 104 may have a slidable coupling with respect to the frame 600 that may permit raising and lowering of the tub chamber 104. The slidable coupling may include a hinge axis 602 passing through a hinge point 618 about which the tub chamber 104 may be pivoted.

Continuing with FIGS. 18 and 19, the frame 600 may include a first frame member 612, a second frame member 614 and a third frame member 616. The first frame member 612 may extend generally in a longitudinal direction, and may be coupled to the second frame member 614 at a first end 618. The first frame member 612 may terminate at a second end 620 near the third frame member 616. The first frame member 612 may also be coupled to the tub chamber 104. The first frame member 612 may, according to advantageous aspects, have a slidable, rotational or a hinged coupling with the second frame member 614. The first frame member 612 may also have a non-slidable coupling with the tub chamber 104.

The first frame member 612 may not be in direct connection to third frame member 616. The third frame member 616 may provide support to the first frame member 612. The third frame member 616, and additional members may keep the frame from moving laterally to reduce or prevent side loading of a position motor of the tilt mechanism (explained further).

In certain embodiments as illustrated in FIGS. 18 and 19, the second frame member 614 may be non-slidably coupled to a fourth frame member 617. The fourth frame member 617 may be connected to a tilt mechanism 630. In some such embodiments, the tilt mechanism 630 may include a position motor 632 and/or a linear actuator 634. The tilt mechanism 630 may be actuated to such that the linear actuator 634 may extend, and thereby bear on the first end 620 of the first frame member 612. As a result of slidable coupling between the first frame member 612 and the second frame member 614 in the vicinity of the first end 618, and the actuation of the linear actuator 634 may result in the first end 618 of the first frame member 612 being pivoted relative to the second frame member 614, thereby pivoting the tub chamber 104 in the direction 636A or in the direction 636B shown in FIGS. 18 and 19.

As mentioned previously, the system may include one or more sensors. In one such embodiment, the system may include a tip sensor 638 which may provide an indication of whether the tub chamber 104 is in the raised or lowered position, and if so, the degree to which the tub chamber 104 has been raised or lowered (e.g., in position or angle). The tip sensor 638 may, in certain aspects, be in electrical communication with the tilt mechanism 630 (e.g., with either the position motor 632 or the linear actuator 634), and may indicate the degree to which the tilt mechanism 630 has been extended or retracted. Alternatively, the tip sensor 638 may be a position encoder provided, for instance, at the second end 620 of the first frame member 612, and may measure the position or rotational angle of the second end 620 of the first frame member 612 or the position or rotational angle of the third frame member 616.

In some optional embodiments that include a tilt mechanism 630 and a tip sensor 638, the controller 400 may control the tipping of the tub chamber 104. In some such embodiments, the controller 400 may receive signals from the tip sensor 638 to determine whether the tipping of the tub chamber 104 is sufficient, for instance, to a desired tip position or angle. If the controller 400 determines that the tipping of the tub chamber 104 is sufficient, the controller 400 may deactivate the tilt mechanism 630 (e.g., by stopping supply of current to the position motor 632 and/or linear actuator 634). If the controller 400 determines that the tipping of the tub chamber 104 is insufficient, the controller 400 may activate the tilt mechanism 630 (e.g., by supplying current to the position motor 632 and/or linear actuator 634) until a desired tip position or angle has been achieved, as indicated by the signals of the tip sensor 638.

In certain optional embodiments, the tub 102 may include a pre-fill tank 136, which may store liquids to facilitate a faster fill of the tub chamber 104. In some such embodiments, the pre-fill and/or filling of the tub chamber 104 may be automated by programming a pre-fill or filling schedule. The program may be executed by the controller 400 to automatically pre-fill, fill and/or drain the tub chamber 104, for instance at specific times (e.g., pre-fill prior to bathing or hydrotherapy so as to reduce wait times, drain at night to reduce the chances of microbial growth in the tub chamber 104, drain if temperature drops below a predetermined value, etc.)

Additional or alternative embodiments may provide additional or alternative sensors. In such cases, the controller 400 may receive signals from additional or alternative sensors, and may perform one or more additional or alternative control operations. Such embodiments may improve safety and ease of use of the disclosed bathing systems.

Exemplary embodiments to the bathing system 100 may also include the use of the display 410 to provide a step-by-step instruction of various functions of the bathing system 100 (e.g., docking, transferring, removing the carrier base 204, and assisting patients during bathing or hydrotherapy procedures, performing cleaning and disinfecting of the tub 102, performing other preventive maintenance, and the like). In some such cases, the instructions may be based on a standard set of instructions, or may be customized to each patient. Accordingly, the display 410 includes a caregiver interface to receive inputs corresponding to patient details, and may communicate with a computer (controller 400 or an external computer) to retrieve patient-specific bathing or hydrotherapy process. The retrieved process may be displayed on the display 410 as a set of instructions (e.g., text, visual, audio, video or animations) which may be easy to use. Exemplary systems and methods may also permit record keeping of processes and display them as reports to supervisory personnel at long-term care facilities, hospitals, and the like. Such embodiments may be useful in documenting regulatory compliance of such facilities.

A variety of remote monitoring and control functions via networked computers and portable devices may be provided. In such cases, the controller 400 of the bathing system 100 may communicate (e.g., wired or wireless connection over a network) to provide current status (bath in process, cleaning in process, down for maintenance, available), reservoir status (full, empty, filling) and water temperature, maintenance history, and the like. Systems disclosed herein may also allow remote data entry for patient preferences, remote data entry for caregiver list, and data upload/download.

Embodiments disclosed herein provide several advantages, such as resulting in safe transfer, improved monitoring and sensing and automation or control of bathing systems and/or the bathing process.

Various examples have been described. These and other examples are within the scope of the following claims.

The invention claimed is:

1. A bathing system, comprising:

a tub, the tub comprising:
- a tub chamber, and
- a support surface within the tub chamber;

a transfer system, the transfer system comprising:
- a carrier base, and
- a transfer seat operatively coupled to the carrier base, the transfer seat being in either a locked position or an unlocked position with respect to the carrier base,
- the locked position limiting a relative motion between the transfer seat and the carrier base,
- the unlocked position facilitating relative motion between the transfer seat and the carrier base and allowing the transfer seat to transfer into or out of the tub chamber by slidably engaging a portion of the transfer seat with the support surface within the tub chamber;

a plurality of sensors, at least a first sensor of the plurality of sensors being configured to sense a position of a first component of the tub or a second component of the transfer system and to generate one or more signals representative thereof;

a controller in operative communication with each sensor of the plurality of sensors, the controller being configured to receive the one or more signals generated by the first sensor, the controller being configured to:

determine, from the one or more signals, whether the position of the first component of the tub and/or the second component of the transfer system corresponds to a first state where it is permissible to transfer the transfer seat into or out of the tub chamber or to a second state where it is not permissible to transfer the transfer seat into or out of the tub chamber, if the controller determines that the one or more signals corresponds to the first state, generate a first output, wherein, the first output includes a first signal for moving the transfer seat from the locked position to the unlocked position; and if the controller determines that the one or more signals corresponds to the second state, generate a second output, wherein, the second output includes a second signal for maintaining the transfer seat in the locked position.

2. The bathing system of claim 1, wherein the first sensor comprises a proximity sensor, the proximity sensor configured to sense whether the transfer system is engaged to the tub.

3. The bathing system of claim 2, wherein the tub comprises a latch and the carrier base comprises a carrier pin, the proximity sensor being configured to sense a distance between the carrier pin and the latch is less than a threshold distance, and if the distance between the carrier pin and the latch is less than the threshold distance, generate a first signal.

4. The bathing system of claim 3, wherein the controller is configured to receive the first signal, and upon receipt of the first signal, the controller determines that the first signal correspond to the first state where it is permissible to transfer the transfer seat into or out of the tub chamber.

5. The bathing system of claim 3, wherein in an absence of the first signal, the controller determines that the absence corresponds to the second state where it is not permissible to transfer the transfer seat into or out of the tub chamber.

6. The bathing system of claim 1, further comprising a display in operative communication with the controller, the controller being configured to communicate with the display to display the first output and/or the second output.

7. The bathing system of claim 1, wherein the transfer seat is lockable with respect to the carrier base by at least one lock.

8. The bathing system of claim 7, wherein the plurality of sensors comprises a second sensor configured to sense whether the at least one lock is in a locked state and generate a second signal.

9. The bathing system of claim 8, wherein the controller is in operative communication with the second sensor, the controller being configured to receive the second signal generated by the second sensor, wherein, upon receipt of the second signal, the controller is configured to generate a third output.

10. The bathing system of claim 1, wherein the tub comprises a tub door configured to move between an open position and a closed position, wherein, the tub door is in the open position during transfer of the transfer seat into or out of the tub chamber.

11. The bathing system of claim 10, wherein plurality of sensors comprises a third sensor configured to:

sense whether the tub door is in the open position, and generate a third signal.

12. The bathing system of claim 11, wherein the controller is in operative communication with the third sensor, the controller being configured to receive the third signal generated by the third sensor, wherein, upon receipt of the third signal, the controller is configured to generate a fourth output.

13. The bathing system of claim 12, wherein the third sensor is configured to generate a fourth signal when the tub door is in the closed position.

14. The bathing system of claim 13, wherein, the controller is configured to:

determine, based on the fourth signal whether the tub chamber is in a state so as to be filled with liquids, if the controller determines that the tub chamber is in a state so as to be filled with liquids, initiate a tub fill operation, and if the controller determines that the tub chamber is in a state not to be filled with liquids, prevent liquids from filling the tub chamber to a level greater than a predetermined level.

15. The bathing system of claim 1, further comprising, one or more nozzles configured to generate one or more whirlpool jets.

16. The bathing system of claim 15, wherein the one or more sensors comprises a fourth sensor configured to sense a level of liquid in the tub chamber and generate a fifth signal.

17. The bathing system of claim 16, wherein the controller is configured to:

receive the fifth signal generated by the fourth sensor, determine, based on the fifth signal whether the tub is in a state so as to actuate the one or more nozzles, if the controller determines that the tub is in a state so as to actuate the one or more nozzles, actuate the one or more nozzles, determine, based on the fifth signal whether the tub is in a state so as to not actuate the one or more nozzles, and if the controller determines that the tub is in a state so as to not actuate the one or more nozzles, do not actuate the one or more nozzles.

18. The bathing system of claim 1, wherein the one or more sensors comprises a fifth sensor configured to sense a level of a cleaning solution in the tub chamber during a cleaning operation.

19. The bathing system of claim 1, wherein the one or more sensors comprises a sixth sensor configured to sense a temperature of a liquid in the tub chamber.

20. A bathing system, comprising:

a tub, the tub comprising:

a tub chamber, and a tub door, the tub door movable between an open position and a closed position;

a transfer system, the transfer system comprising:

a carrier base being dockable with the tub, the carrier base being in either a docked position or undocked position relative to the tub; and a transfer seat being operably coupled to the carrier base, the transfer seat being in either a locked position or an unlocked position relative to the carrier base, the transfer seat being movable relative to the carrier base when the transfer seat is in the unlocked position and laterally movable into the tub chamber through the tub door when the tub door is in the open position;

a plurality of sensors, at least a first sensor of the plurality of sensors being configured to sense the docked or undocked position of the carrier base relative to the tub and to generate one or more signals representative thereof;

a controller in operative communication with each sensor of the plurality of sensors, the controller being configured to receive the one or more signals generated by the first sensor, the controller being configured to:

determine, from the one or more signals, whether the carrier base is in the docked position and generate a first output, wherein the first output includes a first signal for moving the transfer seat from the locked position to the unlocked position;

determine, from the one or more signals, whether the carrier base is in the undocked position and generate a second output, wherein the second output includes a second signal for maintaining the transfer seat in the locked position.

* * * * *